US009353471B2

(12) United States Patent
Choi et al.

(10) Patent No.: US 9,353,471 B2
(45) Date of Patent: May 31, 2016

(54) WASHING MACHINE HAVING BALANCER

(71) Applicant: SAMSUNG ELECTRONICS CO., LTD., Suwon-si, Gyeonggi-do (KR)

(72) Inventors: Min Jea Choi, Suwon (KR); Sung Hwan Kim, Daejeon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 670 days.

(21) Appl. No.: 13/646,055

(22) Filed: Oct. 5, 2012

(65) Prior Publication Data

US 2013/0086953 A1 Apr. 11, 2013

(30) Foreign Application Priority Data

Oct. 6, 2011 (KR) ..... 10-2011-0101767

(51) Int. Cl.
*D06F 37/22* (2006.01)

(52) U.S. Cl.
CPC ..... *D06F 37/225* (2013.01)

(58) Field of Classification Search
CPC ..... D06F 37/225
See application file for complete search history.

(56) References Cited

U.S. PATENT DOCUMENTS

| | | | | |
|---|---|---|---|---|
| 5,906,056 | A * | 5/1999 | Noguchi et al. | 34/596 |
| 5,916,274 | A * | 6/1999 | Lee et al. | 68/23.2 |
| 6,550,292 | B1 * | 4/2003 | Southworth et al. | 68/23.2 |
| 2007/0277561 | A1 * | 12/2007 | Ryu et al. | 68/23.1 |
| 2008/0110212 | A1 | 5/2008 | Kim et al. | |
| 2009/0293551 | A1 * | 12/2009 | Lee et al. | 68/23.2 |
| 2010/0116004 | A1 * | 5/2010 | Kang et al. | 68/23.2 |
| 2010/0186459 | A1 * | 7/2010 | Ryu et al. | 68/23.2 |
| 2010/0269547 | A1 * | 10/2010 | Ryu et al. | 68/23.1 |
| 2011/0041565 | A1 | 2/2011 | Kim et al. | |
| 2011/0094270 | A1 * | 4/2011 | Hong et al. | 68/23.2 |
| 2011/0179831 | A1 * | 7/2011 | Ryu et al. | 68/139 |
| 2011/0203323 | A1 * | 8/2011 | Ryu et al. | 68/139 |

FOREIGN PATENT DOCUMENTS

| | | | |
|---|---|---|---|
| CN | 101177874 | A | 5/2008 |
| CN | 101581022 | A | 11/2009 |
| CN | 101994230 | A | 3/2011 |
| CN | 102041658 | A | 5/2011 |
| EP | 1182291 | A2 | 2/2002 |
| EP | 1862577 | A2 | 12/2007 |

(Continued)

OTHER PUBLICATIONS

International Search Report mailed Feb. 26, 2013 for corresponding International Application No. PCT/KR2012/007981.

(Continued)

*Primary Examiner* — Joseph L Perrin
(74) *Attorney, Agent, or Firm* — Staas & Halsey LLP

(57) ABSTRACT

A washing machine with a balancer that may be commonly used irrespective of the size of a drum. The washing machine includes a cabinet, a drum rotatably disposed in the cabinet, an annular recess provided at the drum, and a balancer assembly mounted to the recess. The balancer assembly includes a balancer to offset unbalanced load generated in the drum during rotation of the drum and at least one balancer guide coupled to an outer circumference of the balancer to constitute the balancer assembly, the balancer guide being mounted to the recess along with the balancer so that an outer diameter of the balancer assembly corresponds to the recess.

29 Claims, 21 Drawing Sheets

(56) References Cited

FOREIGN PATENT DOCUMENTS

| | | | |
|---|---|---|---|
| EP | 2314750 | A1 | 4/2011 |
| KR | 10-2006-0053747 | | 5/2006 |
| KR | 10-2007-0115287 | | 12/2007 |
| KR | 10-2007-0115292 | | 12/2007 |

OTHER PUBLICATIONS

Extended European Search Report mailed Mar. 13, 2013 for corresponding European Application No. 12187617.1.
Chinese Office Action mailed Nov. 17, 2015 in related Chinese Application No. 201210377960.0.

* cited by examiner

WASHING MACHINE HAVING BALANCER

CROSS-REFERENCE TO RELATED APPLICATIONS

This application claims the priority benefit of Korean Patent Application No. 10-2011-0101767, filed on Oct. 6, 2011 in the Korean Intellectual Property Office, the disclosure of which is incorporated herein by reference.

BACKGROUND

1. Field

Embodiments of the present disclosure relate to a washing machine having a balancer to offset unbalanced load generated during rotation of a drum.

2. Description of the Related Art

A washing machine washes laundry using electric force. Generally, a washing machine includes a cabinet forming the external appearance thereof, a tub disposed in the cabinet to contain wash water, a drum rotatably mounted in the tub, and a motor to rotate the drum.

When the drum is rotated by the motor in a state in which laundry and detergent water are contained in the drum, the laundry rubs against the drum and wash water so that contaminants are removed from the laundry.

If the laundry is not uniformly distributed in the drum but accumulates at one side during rotation of the drum, vibration and noise are generated by eccentric rotation of the drum. In the worst case, the drum or the motor may be damaged. To prevent such eccentric rotation of the drum, a balancer to offset unbalanced load generated in the drum to stabilize rotation of the drum is mounted to the drum.

In recent years, consumer demand for a washing machine to wash a large amount of laundry at once has been increased, and therefore, washing capacity of the washing machine has gradually been increased.

Washing capacity is related to the size of the drum. The diameter of the drum is increased to increase the size of the drum. If the diameter of the drum is increased, the diameter of the balancer mounted to the drum is also increased. However, it takes substantial cost and time to develop various balancers corresponding to different diameters of the drum.

SUMMARY

It is an aspect of the present disclosure to provide a washing machine with an improved balancer that is commonly used irrespective of the size of a drum.

Additional aspects of the disclosure will be set forth in part in the description which follows and, in part, will be apparent from the description, or may be learned by practice of the disclosure.

In accordance with one aspect of the present disclosure, a washing machine includes a cabinet, a drum rotatably disposed in the cabinet, an annular recess provided at the drum, and a balancer assembly mounted to the recess, wherein the balancer assembly includes a balancer to offset unbalanced load generated in the drum during rotation of the drum and at least one balancer guide coupled to an outer circumference of the balancer to constitute the balancer assembly, the balancer guide being mounted to the recess along with the balancer so that an outer diameter of the balancer assembly corresponds to the recess.

The balancer may include a plurality of fastening ribs disposed in a circumferential direction thereof and at least one support rib disposed between the fastening ribs.

The balancer may include a plurality of fastening ribs disposed in a circumferential direction thereof, and the balancer guide contacts at least one of the fastening ribs.

The balancer may include a plurality of fastening ribs disposed in a circumferential direction thereof and at least one support rib disposed between the fastening ribs, and the balancer guide may contact at least one of the fastening ribs and the at least one support rib.

The balancer may include a plurality of support ribs provided at the outer circumference of the balancer so as to be disposed in a circumferential direction of the balancer, and the support ribs may include a first support rib to support a first end of the balancer guide in a circumferential direction of the balancer guide in a state in which the balancer guide is coupled to the balancer and a second support rib spaced apart from the first support rib to support a second end of the balancer guide in a direction opposite to the first end.

The first end and the second end may include a first catching protrusion and a second catching protrusion stepped from an inner circumference of the balancer guide and supported by one surface of the first support rib and one surface of the second support rib.

The first support rib and the second support rib may be disposed between the first catching protrusion and the second catching protrusion.

The inner distance between the first catching protrusion and the second catching protrusion in the circumferential direction of the balancer may be less than the outer distance between the first support rib and the second support rib.

The first support rib and the second support rib may be disposed outside the first catching protrusion and the second catching protrusion, respectively.

The outer distance between the first catching protrusion and the second catching protrusion in the circumferential direction of the balancer may be greater than the inner distance between the first support rib and the second support rib.

The balancer guide may include a positioning protrusion provided between the first end and the second end, protruding from an inner circumference of the balancer guide to a radial-directional inside of the balancer guide, and inserted between adjacent support ribs.

The balancer guide may include at least one fastening hook fastened to the outer circumference of the balancer to press the outer circumference of the balancer in a center direction of the balancer.

The fastening hook may be formed at an inner circumference of the balancer guide, and one end of the fastening hook fastened to the outer circumference of the balancer may protrude much more in the center direction of the balancer than the inner circumference of the balancer guide.

The balancer may include a ball balancer including an annular housing and a plurality of balls movably disposed in the housing.

The at least one balancer guide may include a plurality of balancer guides disposed in a circumferential direction of the balancer.

The recess may include a first support surface to support an inner circumference of the balancer, a second support surface to support an outer circumference of the balancer guide, and a third support surface connected between the first support surface and the second support surface to support the balancer and the balancer guide in an axial direction of the drum.

The balancer may include a plurality of fastening ribs provided at the outer circumference of the balancer so as to be disposed in a circumferential direction of the balancer.

Each of the fastening ribs may include at least one receiving groove, and the balancer guide may include at least one fastening protrusion protruding from an inner circumference thereof so as to be received and coupled in the receiving groove.

The balancer may include an annular balancer housing forming the external appearance thereof, and the balancer guide may include a catching part surrounding a portion of an outside of the balancer housing to prevent the balancer guide from moving in a center direction and in an axial direction in a state in which the balancer guide is coupled to the balancer.

The catching part may include a first support protrusion to support a front of the balancer housing and a second support protrusion to support a rear of the balancer housing so that the balancer guide is prevented from moving in the axial direction.

The catching part may include a support surface provided between the first support protrusion and the second support protrusion to support an outer circumference of the balancer housing.

In accordance with another aspect of the present disclosure, a washing machine includes a drum including a cylinder part, a front plate disposed at a front of the cylinder part, and a rear plate disposed at a rear of the cylinder part, an annular recess provided at the front plate and/or the rear plate, a balancer mounted to the annular recess to offset unbalanced load generated in the drum during rotation of the drum, and a balancer guide disposed in a space defined by an outer circumference of the balancer and the recess to support the balancer.

The recess may include a first support surface to support an inner circumference of the balancer and a second support surface provided at an outward radial-directional position so as to be spaced apart from the first support surface, and the balancer guide may be disposed between the outer circumference of the balancer and the second support surface.

The recess may include a third support surface connected between the first support surface and the second support surface to support the balancer and the balancer guide in an axial direction of the drum.

The balancer guide may include at least two balancer guides disposed between the outer circumference of the balancer and the second support surface in a circumferential direction of the balancer.

The balancer may include a plurality of support ribs provided at the outer circumference of the balancer so as to be disposed in a circumferential direction of the balancer, and the balancer guide may be provided at opposite ends thereof with a first catching protrusion and a second catching protrusion formed at a radial-directional inside of the balancer guide so as to be stepped from an inner circumference of the balancer guide, the first catching protrusion and the second catching protrusion contacting corresponding surfaces of two different ones of the support ribs.

The first catching protrusion may press one of the two different support ribs in the circumferential direction of the balancer, and the second catching protrusion may press the other support rib in a direction opposite to the circumferential direction.

The balancer guide may include a positioning protrusion provided between the first catching protrusion and the second catching protrusion, protruding from the inner circumference of the balancer guide to the radial-directional inside of the balancer guide, and inserted between adjacent support ribs.

The balancer guide may include at least one fastening hook protruding from an inner circumference of the balancer guide to a radial-directional inside of the balancer guide, and the fastening hook may be fastened to the outer circumference of the balancer to press the outer circumference of the balancer in a center direction of the balancer.

In accordance with a further aspect of the present disclosure, a washing machine includes a cabinet, a drum rotatably disposed in the cabinet, an annular recess provided at the drum, a balancer mounted to the recess to stabilize rotation of the drum during rotation of the drum, and at least one fastening member coupled to an outer circumference of the balancer to fasten the balancer to the recess.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
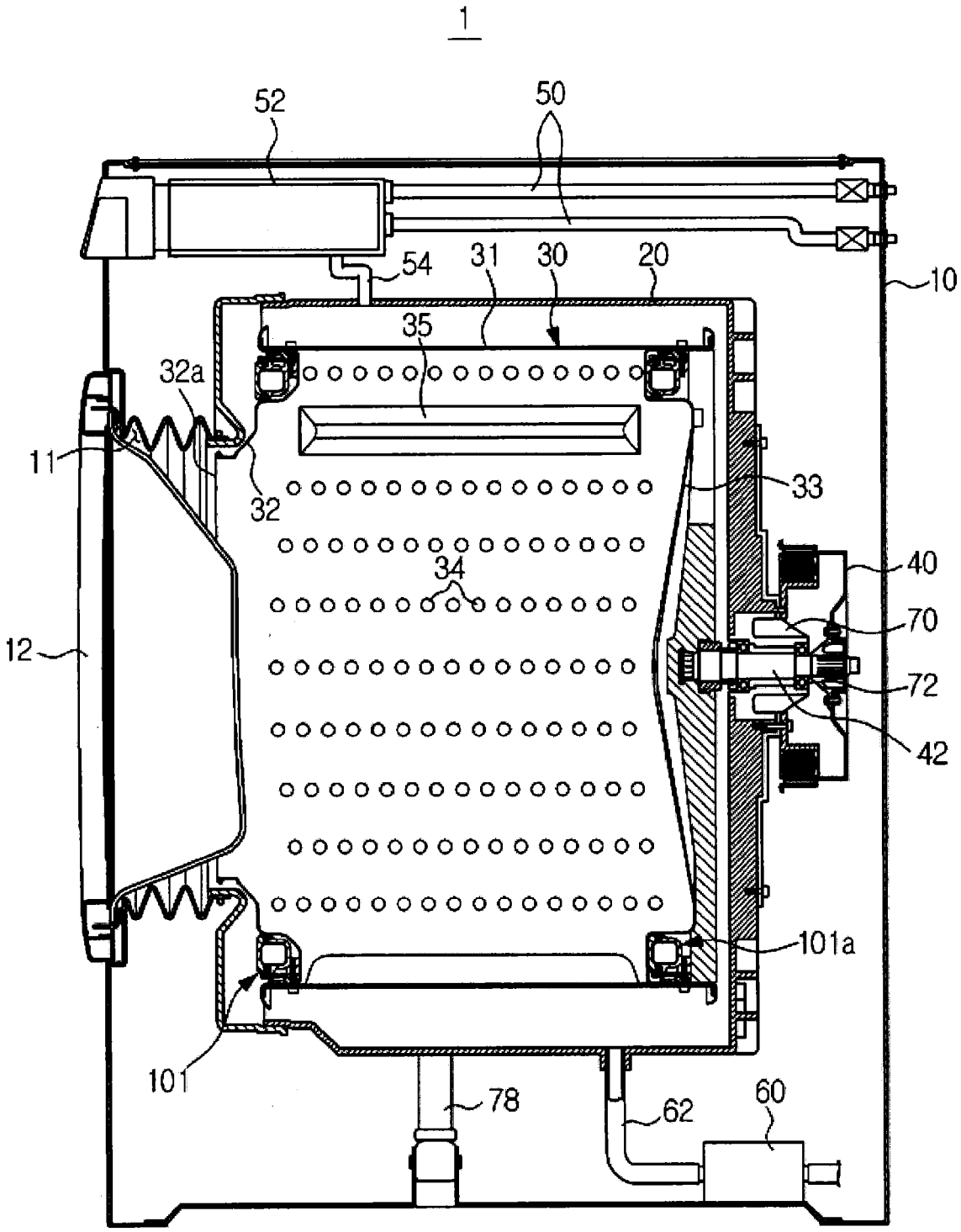
FIG. 1 is a view showing the construction of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a view showing the construction of a washing machine according to an embodiment of the present disclosure.

As shown in FIG. 1, a washing machine 1 includes a cabinet 10 forming the external appearance thereof, a tub 20 disposed in the cabinet 10, a drum 30 rotatably disposed in the tub 20, and a motor 40 to drive the drum 30.

An introduction port 11, through which laundry is introduced into the drum 30, is formed at the front of the cabinet 10. The introduction port 10 is opened and closed by a door 12 installed at the front of the cabinet 10.

Above the tub 20 is installed a water supply pipe 50 to supply wash water to the tub 20. One side of the water supply pipe 50 is connected to a water supply valve 56, and the other side of the water supply pipe 50 is connected to a detergent supply device 52.

The detergent supply device 52 is connected to the tub 20 via a connection pipe 54. Water, supplied through the water supply pipe 50, is supplied into the tub 20 together with a detergent via the detergent supply device 52.

Under the tub 20 are installed a drainage pump 60 and drainage pipe 62 to discharge water in the tub 20 out of the cabinet 10.

The drum 30 includes a cylinder part 31, a front plate 32 disposed at the front of the cylinder part 31, and a rear plate 33 disposed at the rear of the cylinder part 31. An opening 32*a*, through which laundry is introduced and removed, is formed at the front plate 32. A drive shaft 42 to transmit power from the motor 40 to the drum 30 is connected to the rear plate 33.

The drum 30 is provided at the circumference thereof with a plurality of through holes 34, through which wash water flows. The drum 30 is provided at the inner circumference thereof with a plurality of lifters 35, by which laundry is raised and dropped when the drum 30 is rotated.

The drive shaft 42 is disposed between the drum 30 and the motor 40. One end of the drive shaft 42 is connected to the rear plate 33 of the drum 30, and the other end of the drive shaft 42 extends to the outside of the rear wall of the tub 20. When the drive shaft 42 is driven by the motor 40, the drum 30 connected to the drive shaft 42 is rotated about the drive shaft 42.

At the rear wall of the tub 20 is installed a bearing housing 70 to rotatably support the drive shaft 42. The bearing housing 70 may be made of an aluminum alloy. The bearing housing 70 may be inserted into the rear wall of the tub 20 when the tub 20 is injection molded. Between the bearing housing 70 and the drive shaft 42 are installed bearings 72 to smoothly support the rotation of the drive shaft 42.

The tub 20 is supported by a damper 78. The damper 78 is connected between the inside bottom of the cabinet 10 and the outside of the tub 20.

During a washing cycle, the motor 40 rotates the drum 30 in alternating directions at low speed. As a result, laundry in the drum 30 is repeatedly raised and dropped so that contaminants are removed from the laundry.

During a spin-drying cycle, the motor 40 rotates the drum 30 in one direction at high speed. As a result, water is separated from laundry by centrifugal force applied to the laundry.

If the laundry is not uniformly distributed in the drum 30 but accumulates at one side when the drum 30 is rotated during the spin-drying, rotation of the drum 30 is unstable, generating vibration and noise.

For this reason, the washing machine 1 includes balancer assemblies 100 and 100*a* to stabilize rotation of the drum 30.

The balance assemblies 100 and 100*a* include balancers 101 and 101*a* to offset unbalanced load generated in the drum 30 during rotation of the drum 30 and balancer guides 160 and 160*a* coupled to the outer circumferences of the balancers 101 and 101*a* so that the balancers 101 and 101*a* are commonly used irrespective of the diameter of the drum 30. The balancer guide 160 is disposed between a recess 38 and the balancer 101 so as to be used as a fastening member to fasten the balancer 101 to the drum 30 so that the balancer 101 is fixed to the drum 30.

Figure 2:
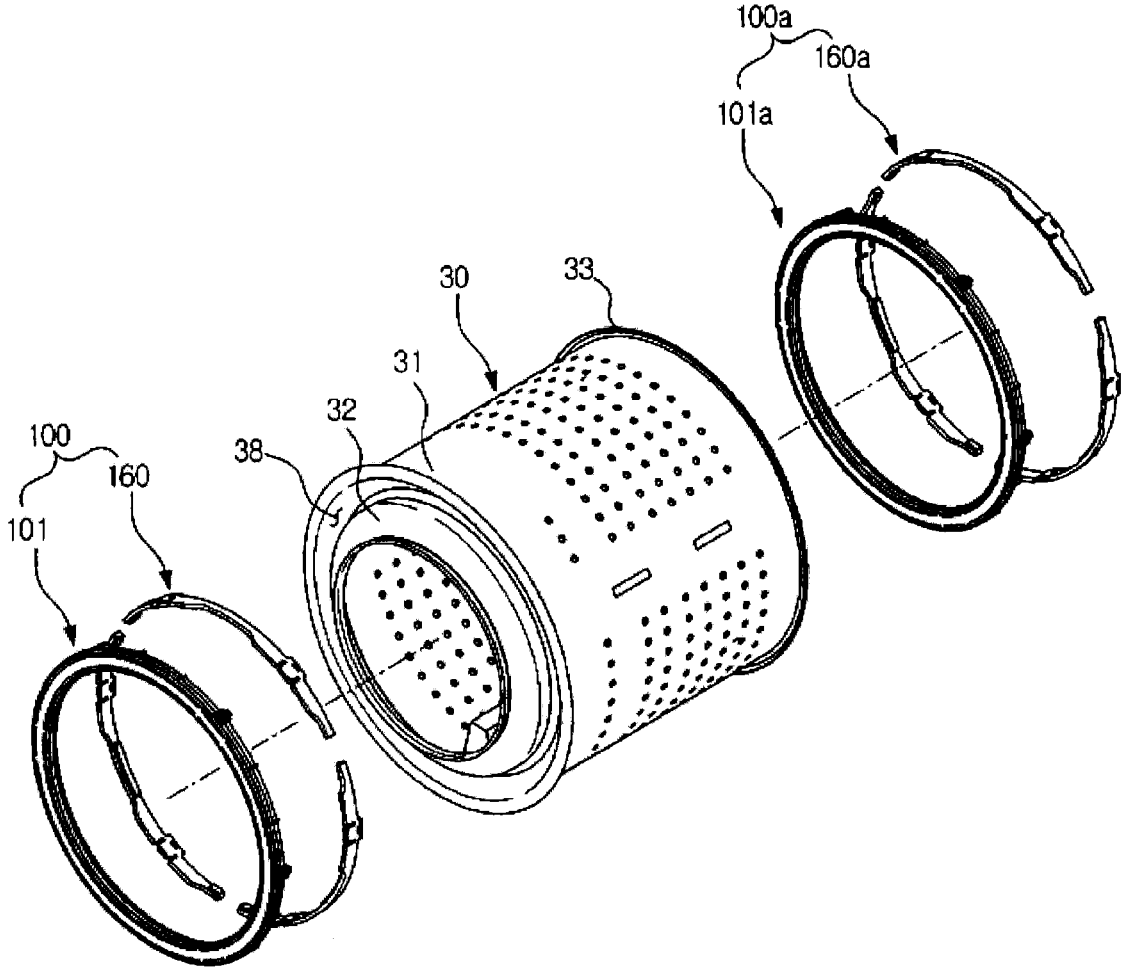
FIG. 2 is an exploded perspective view showing a drum, balancers, and balancer guides of the washing machine according to the embodiment of the present disclosure.
Figure 3:
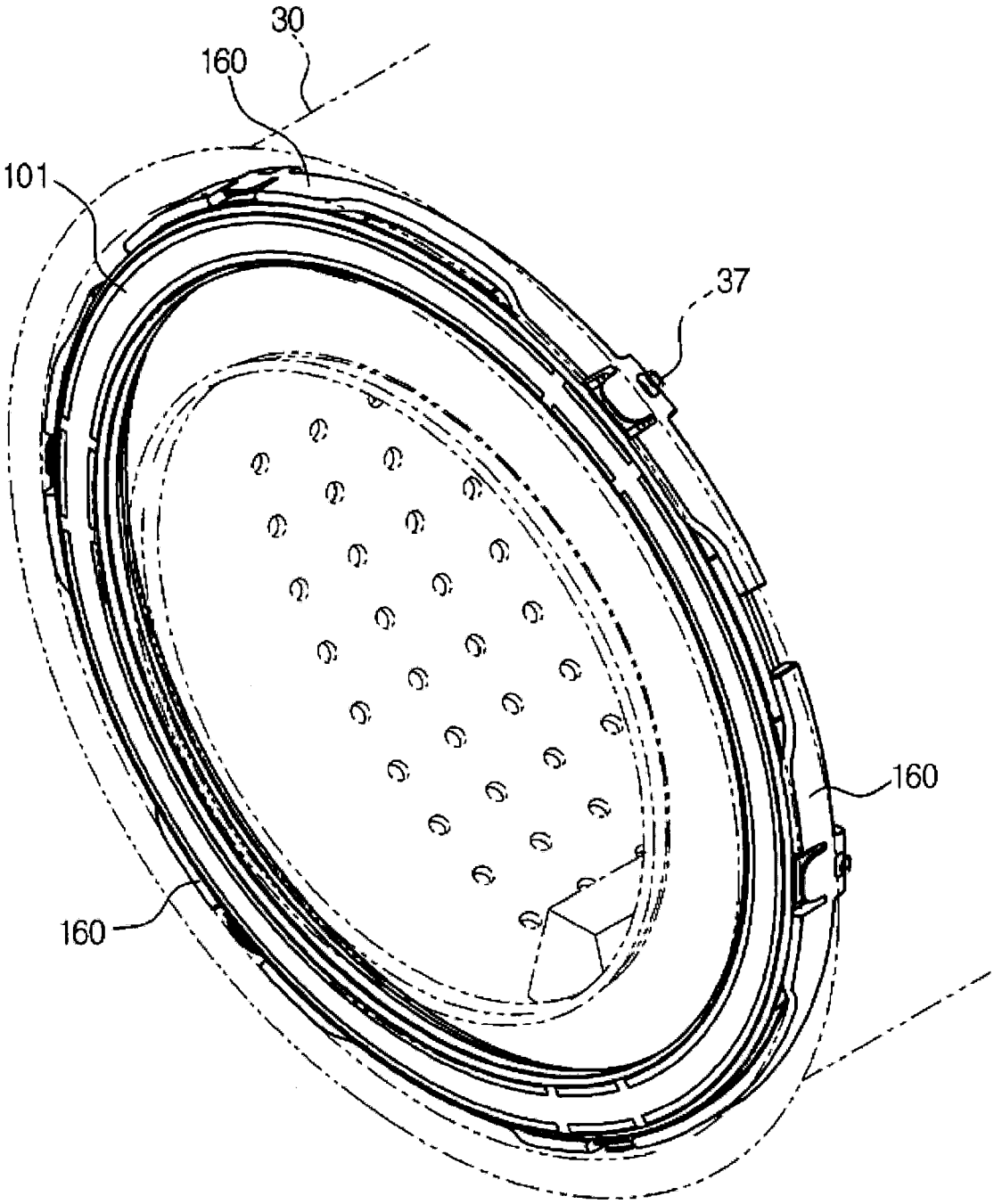
FIG. 3 is a perspective view showing the drum, balancer, and balancer guide of the washing machine according to the embodiment of the present disclosure.
Figure 4:
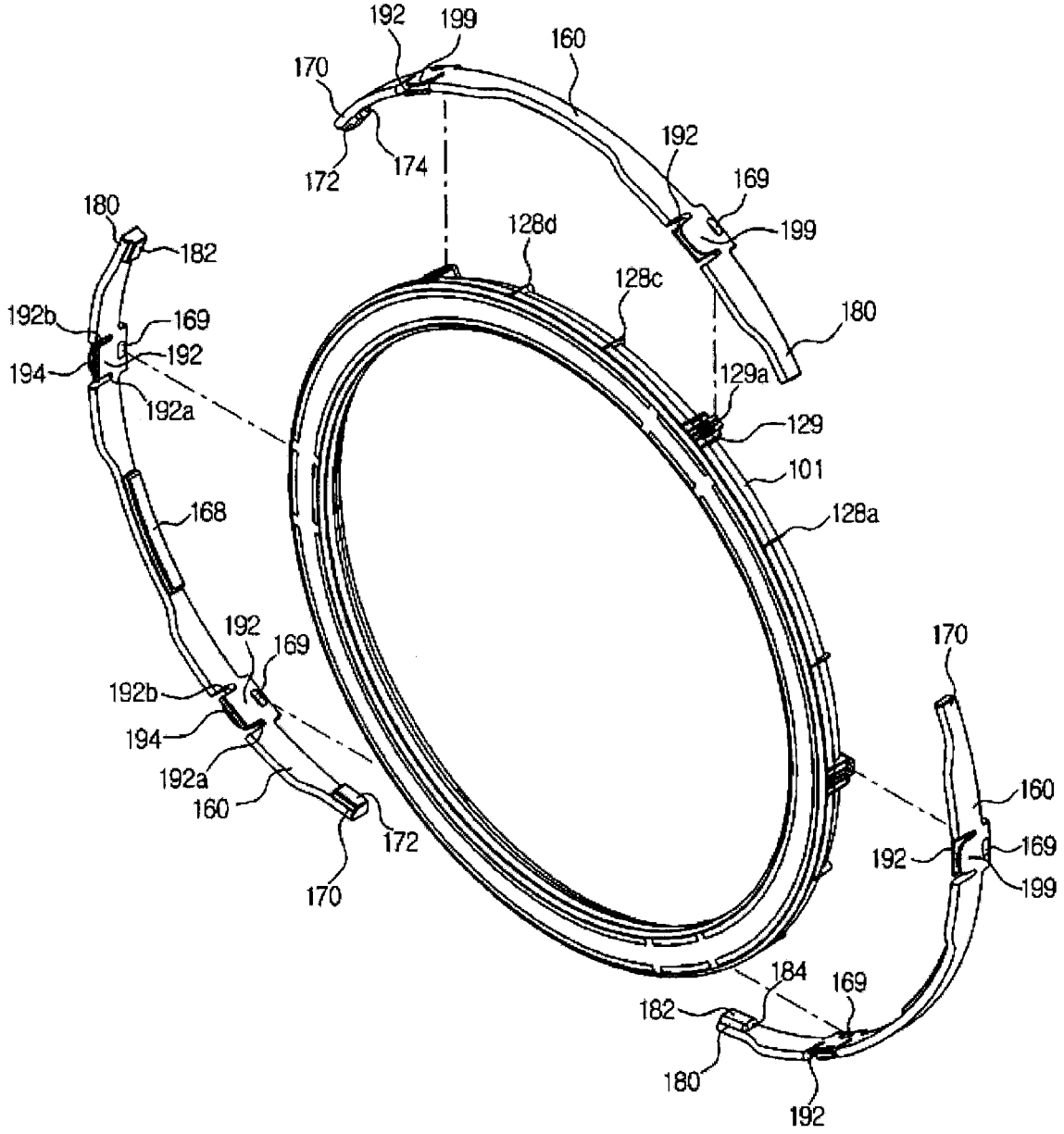
FIG. 4 is an exploded perspective view showing a balancer guide and balancer according to an embodiment of the present disclosure.
Figure 5:
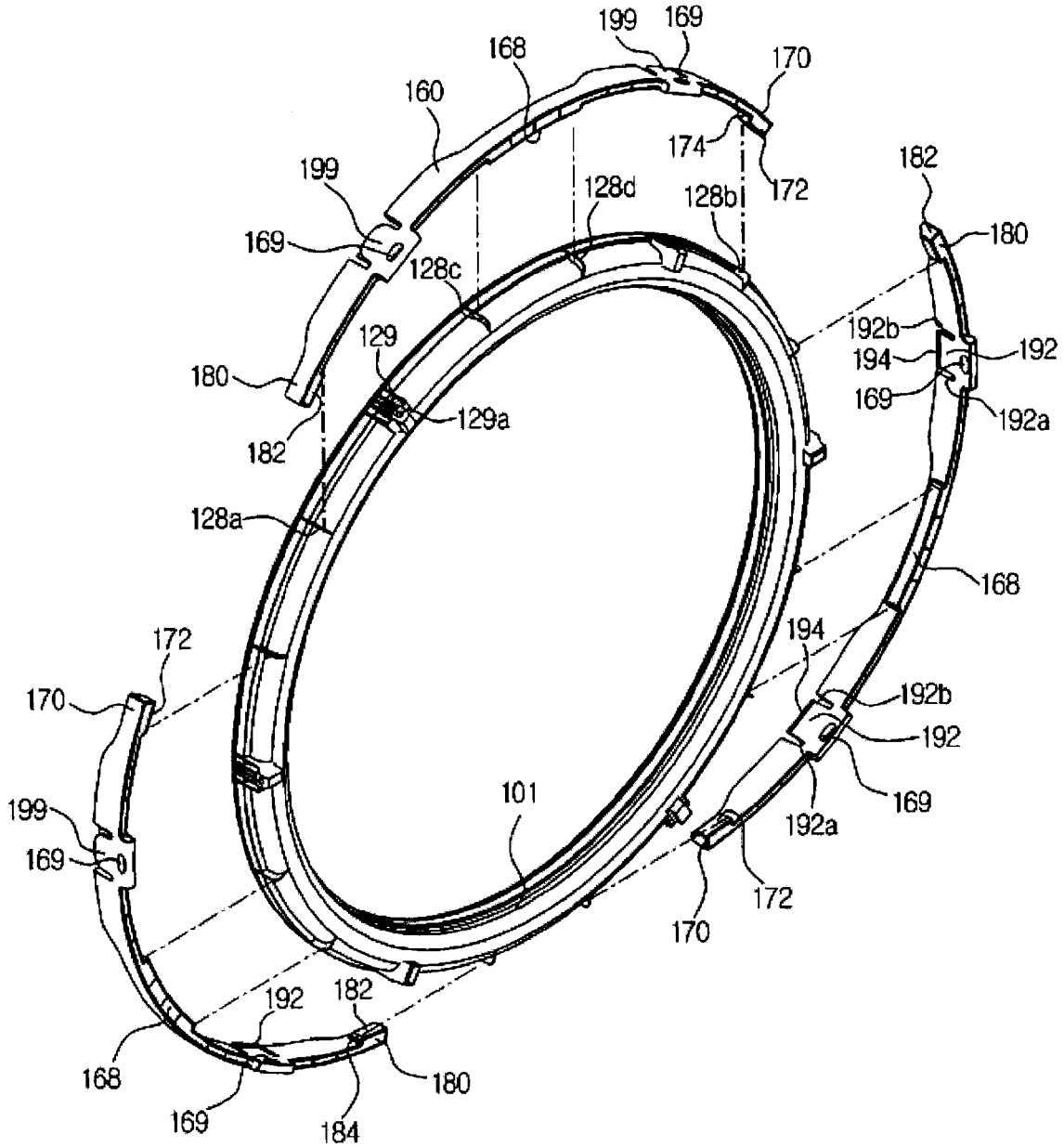
FIG. 5 is an exploded perspective view showing the balancer guide and balancer shown in FIG. 4 when viewed from the rear thereof.
Figure 6:
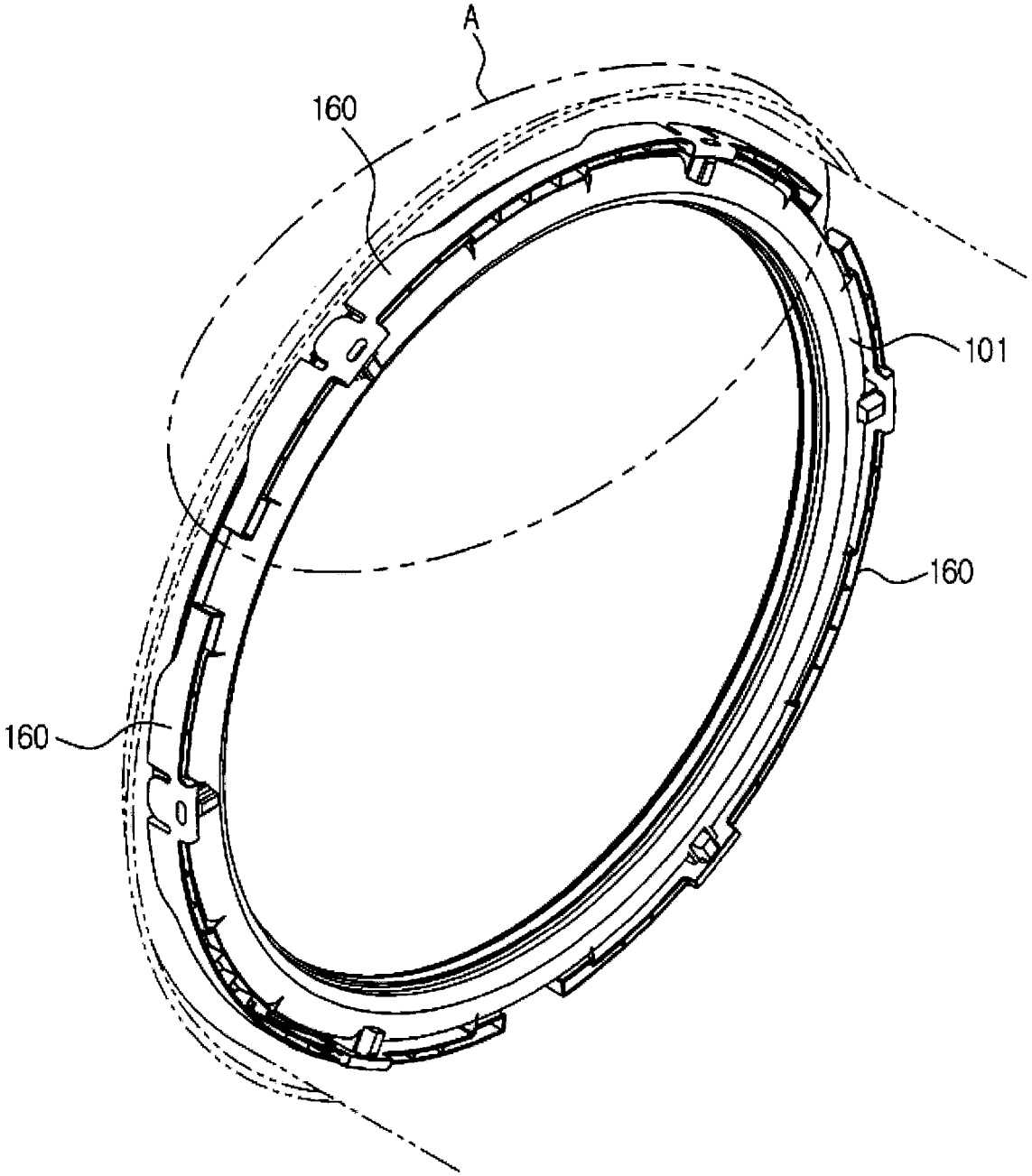
FIG. 6 is a view showing a state in which the balancer guide is coupled to the balancer of FIG. 5.
Figure 7:
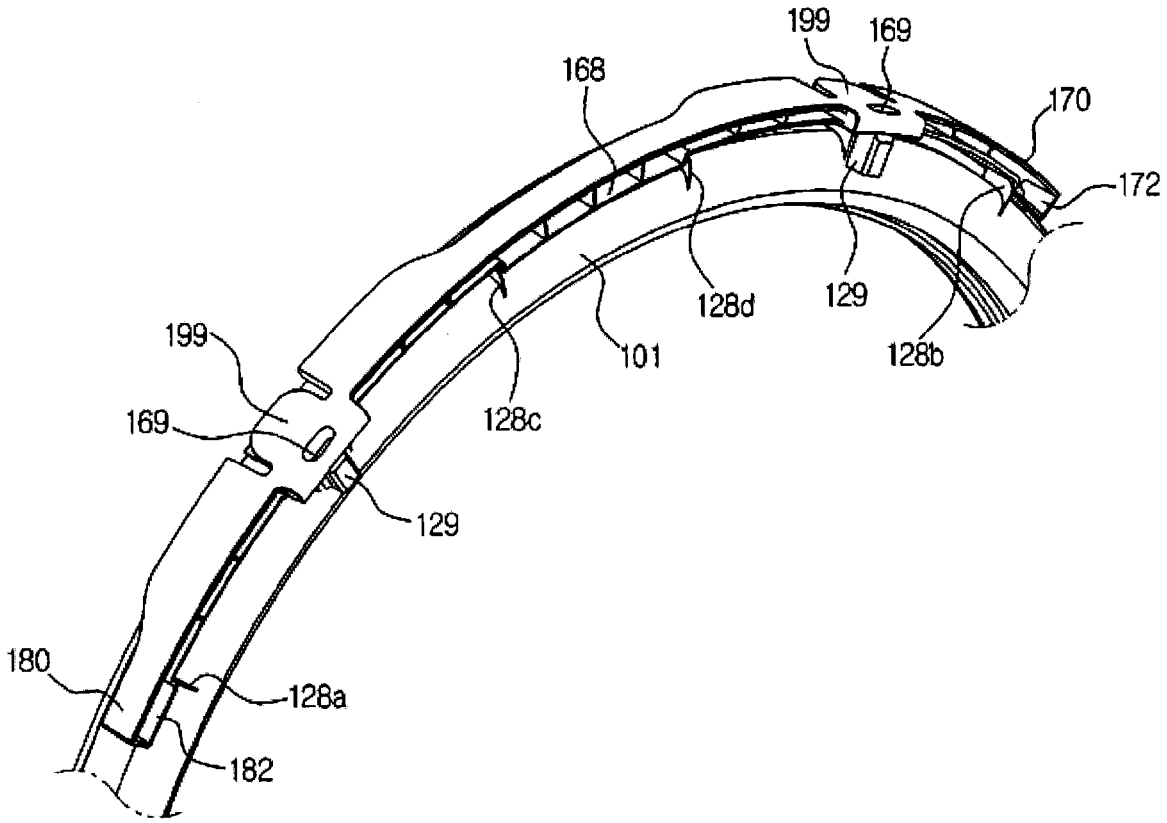
FIG. 7 is an enlarged view showing part A of FIG. 6.
Figure 8:
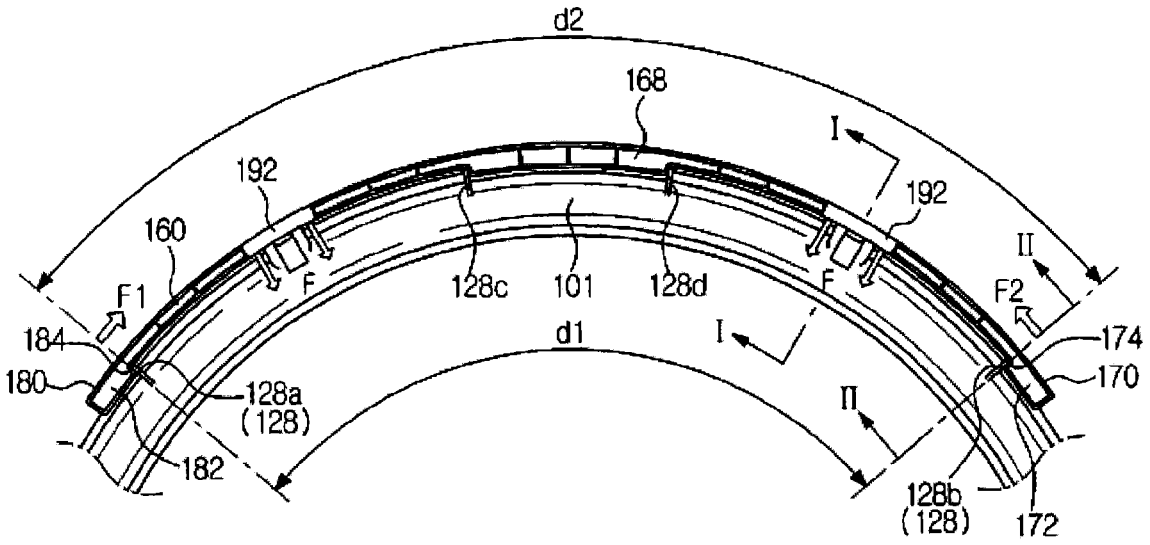
FIG. 8 is a plan view of FIG. 7.
Figure 9:
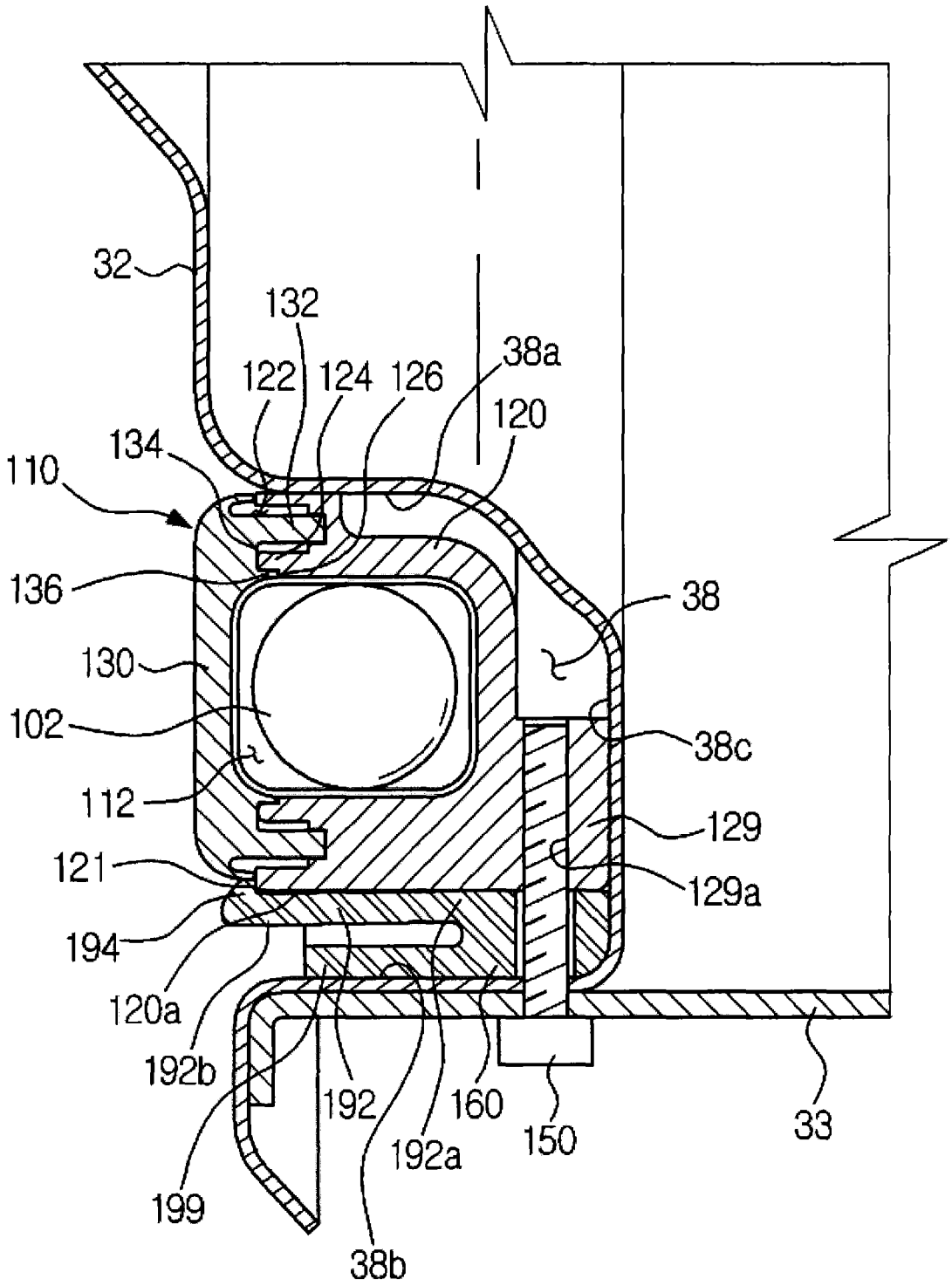
FIG. 9 is a sectional view taken along line I-I of FIG. 8.
Figure 10:
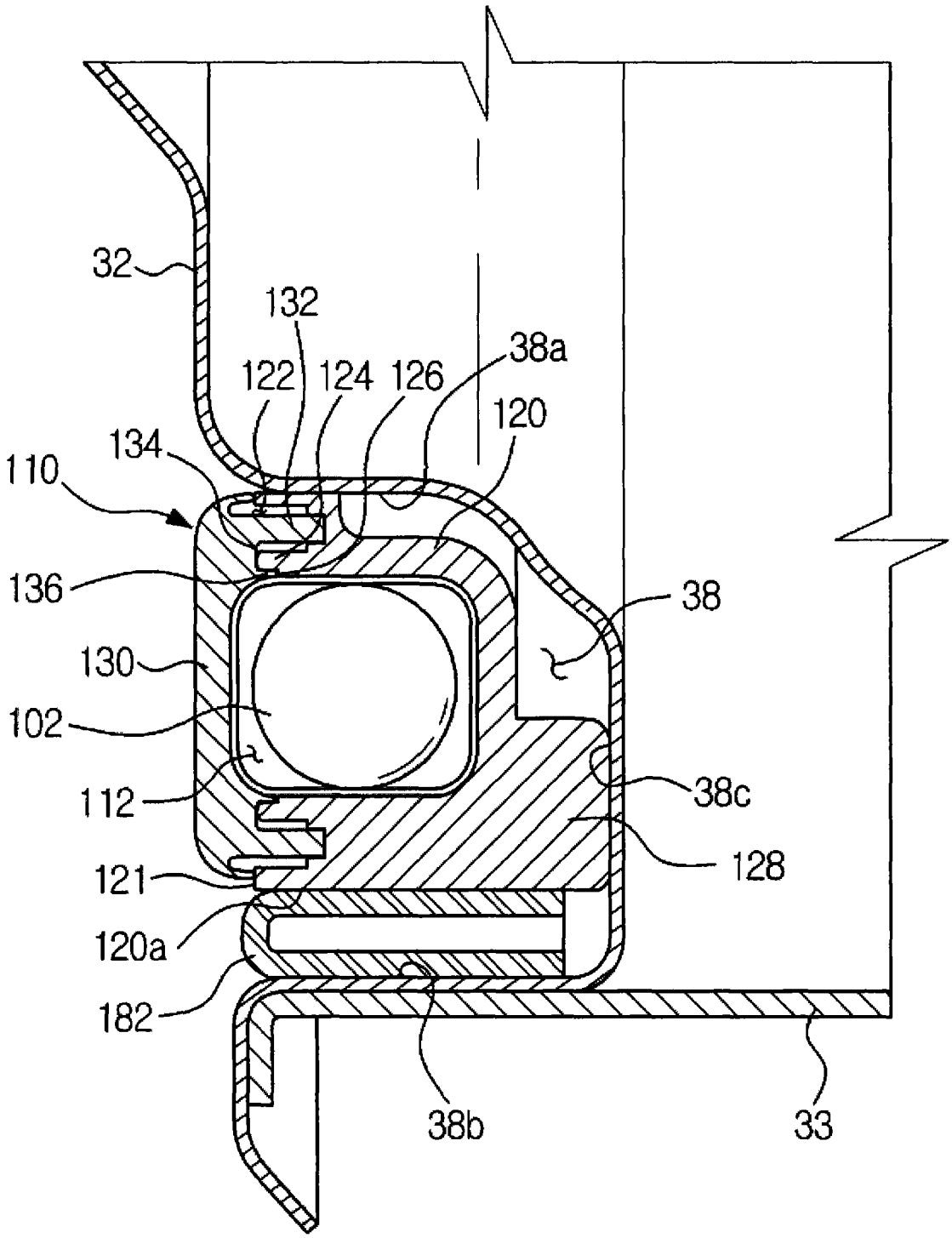
FIG. 10 is a sectional view taken along line II-II of FIG. 8.

FIG. 2 is an exploded perspective view showing the drum, balancers, and balancer guides of the washing machine according to the embodiment of the present disclosure, FIG. 3 is a perspective view showing the drum, balancer, and balancer guide of the washing machine according to the embodiment of the present disclosure, FIG. 4 is an exploded perspective view showing a balancer guide and balancer according to an embodiment of the present disclosure, FIG. 5 is an exploded perspective view showing the balancer guide and balancer shown in FIG. 4 when viewed from the rear thereof, FIG. 6 is a view showing a state in which the balancer guide is coupled to the balancer of FIG. 5, FIG. 7 is an enlarged view showing part A of FIG. 6, FIG. 8 is a plan view of FIG. 7, FIG. 9 is a sectional view taken along line I-I of FIG. 8, and FIG. 10 is a sectional view taken along line II-II of FIG. 8.

As shown in FIGS. 1 to 10, the balancer 101 and 101*a* and the balancer guide 160 and 160*a* may be mounted to the front plate 32 and/or the rear plate 33 of the drum 30. The balancer 101*a* mounted to the rear plate 33 is similar in construction to the balancer 101 mounted to the front plate 32. Hereinafter, a description will be given of the balancer 101 mounted to the front plate 32 and the balancer guide 160.

The balancer 101 includes a plurality of balls 102 to perform a balancing function, a balancer housing 110 having an annular channel 112 to contain the balls 102, and oil to prevent abrupt movement of the balls 102 in the channel 112. 60 to 80% of the volume of the channel 112 may be filled with the oil. The oil partially performs a function to balance the drum 30 along with the balls 102 during rotation of the drum 30.

An annular recess 38, which is open at the front thereof, is formed at the front plate 32 of the drum 30. The balancer housing 110 is disposed in the recess 38. The balancer housing 110 may be coupled to the drum 30 by fixing members 150 so that the balancer housing 110 is securely fixed to the drum 30.

The balancer housing 110 includes a first annular housing 120 opened at one side thereof and a second housing 130 to cover the opening of the first housing 120. The inside of the first housing 120 and the inside of the second housing 130 define the annular channel 112.

The first housing 120 has first coupling grooves 122 formed at opposite sides of the channel 112, and the second housing 130 has first coupling protrusions 132 coupled in the first coupling grooves 122. Second coupling protrusions 124 are formed between the first coupling grooves 122 of the first housing 120 and the channel 112. The second coupling protrusions 124 of the first housing 120 are coupled in second coupling grooves 134 formed at the insides of the first coupling protrusions 132. Third coupling grooves 126 are formed at the insides of the second coupling protrusions 124 adjacent to the channel 112, and the second housing 130 has third coupling protrusions 136 coupled in the third coupling grooves 126. In the above coupling structure, the first housing 120 and the second housing 130 are securely coupled to each other, and, in a case in which a fluid, such as oil, is contained in the channel 112, leakage of the fluid is prevented.

The first housing 120 is provided at the outer circumference 120*a* thereof with a plurality of support ribs 128 arranged at predetermined intervals in the circumferential direction of the balancer 101. The support ribs 128 extend from the outer circumference 120*a* of the first housing 120 by a predetermined length. In a state in which the balancer guide 160 is coupled to the balancer 101, the support ribs 128 support opposite ends of the balancer guide 160 in the circumferential direction of the balancer guide 160 or in the direction opposite thereof so that the balancer guide 160 is coupled to the balancer 101.

Also, the first housing 120 is provided at the outer circumference 120*a* thereof with a plurality of fastening ribs 129 arranged at predetermined intervals in the circumferential direction of the balancer 101 along with the support ribs 128. The fastening ribs 129 extend from the outer circumference 120*a* of the first housing 120 by a predetermined length. Each of the fastening ribs 129 has at least one fastening hole 129*a*, through which a fixing member 150 is inserted so that the first housing 120 is coupled to the drum 30

At least two balancer guides 160 may be arranged in the circumferential direction of the balancer 101 at predetermined intervals so that the balancer guides 160 are coupled to the balancer 101, specifically the outer circumference 120*a* of the first housing 120.

Each balancer guide 160 is provided at opposite ends 170 and 180 thereof with a first catching protrusion 172 and a second catching protrusion 182, which are supported by the support ribs 128 in a state in which each balancer guide 160 is coupled to the balancer 101.

The first catching protrusion 172 and the second catching protrusion 182 are stepped from the inner circumference of the balancer guide 160, which forms the inner diameter thereof. The first catching protrusion 172 and the second catching protrusion 182 respectively include a first contact surface 174 and a second contact surface 184 contacting corresponding surfaces of the support ribs 128 to press the corresponding surfaces of the support ribs 128 so that the balancer guide 160 is not separated from the balancer 101.

In a state in which the balancer guide 160 is coupled to the balancer 101, two different support ribs 128*a* and 128*b* are disposed between the first contact surface 174 and the second contact surface 184 in contact with the first contact surface 174 and the second contact surface 184 to support the first contact surface 174 and the second contact surface 184 in different directions.

The outer distance d2 between the support ribs 128*a* and 128*b* in the circumferential direction of the balancer guide 160 may be greater than the inner distance d1 between the first catching protrusion 172 and the second catching protrusion 182, i.e. the distance between the first contact surface 174 and the second contact surface 184. In a state in which the balancer guide 160 is coupled to the balancer 101, therefore, the first contact surface 174 and the second contact surface 184 press the support ribs 128*a* and 128*b* in different directions F1 and F2 using elastic restoring force generated by the increase of the distance between the first contact surface 174 and the second contact surface 184 corresponding to the outer distance d2 between the support ribs 128*a* and 128*b* so that the balancer guide 160 is not separated from the balancer 101 but is securely fixed to the balancer 101. To prevent separation of the balancer guide 160, the outer distance d2 between the support ribs 128*a* and 128*b* may be about 0.5 mm to 1.5 mm greater than the inner distance d1 between the first catching protrusion 172 and the second catching protrusion 182.

The balancer guide 160 may include a positioning protrusion 168 disposed between the first catching protrusion 172 and the second catching protrusion 182 to protrude from the inner circumference of the balancer guide 160, which forms the inner diameter thereof, in the center direction of the balancer guide 160.

During the coupling of the balancer guide 160 to the balancer 101, the positioning protrusion 168 is inserted between two adjacent support ribs 128*c* and 128*d*. Before fixing the balancer guide 160 to the balancer 101 using the first catching protrusion 172 and the second catching protrusion 182, a worker may reliably decide a coupling position between the balancer 101 and the balancer guide 160 using the positioning protrusion 168.

The balancer guide 160 may further include fastening hooks 192 disposed at positions corresponding to the fastening ribs 129 so as to be fastened to the outer circumference of the balancer 101 in a state in which the balancer guide 160 is coupled to the balancer 101.

Each fastening hook 192 includes a fixed end 192*a* and a free end 192*b*. The free end 192*b* is formed by cutting a portion of the inner circumference of the balancer guide 160, which forms the inner diameter thereof, so that the free end 192*b* is easily elastically deformed approximately in the center direction or radial direction of the balancer guide 160.

The free end 192*b* is provided with a hook protrusion 194 protruding from the inner circumference of the balancer guide 160 to the radial-directional inside of the balancer guide 160. As shown in FIG. 9, the hook protrusion 194 is caught by a step protrusion 121 formed by the first housing 120 and the second housing 130 so that the balancer guide 160 is not separated from the balancer 101 but is securely fixed to the balancer 101.

As shown in FIG. 9, the hook protrusion 194 presses the outer circumference of the balancer 101 in the center direction F of the balancer guide 160 by elastic restoring force generated as the hook protrusion 194 is deformed in the radial direction of the balancer guide 160 when the hook protrusion 194 is fastened to the step protrusion 121 so that the balancer guide 160 is not separated from the balancer 101 but is securely fixed to the balancer 101 along with the first catching protrusion 172 and the second catching protrusion 182. To prevent separation of the balancer guide 160, the length of the hook protrusion 194 protruding toward the radial-directional inside of the balancer guide 160 may be about 0.5 mm to 1.5 mm.

The balancer guide 160 includes a pressing rib 199 provided at the outside of each fastening hook 192 in the radial direction of the balancer guide 160 so that the fastening hook 192 presses the outer circumference of the balancer 101 as described above.

The pressing rib 199 supports the hook protrusion 194 in the center direction F of the balancer guide 160 in a state in which the hook protrusion 194 is fastened to the step protrusion 121 so that the hook protrusion 194 stably presses the outer circumference of the balancer 101 in the center direction F of the balancer guide 160.

As described above, the balancer guide 160 is fastened and supported in the circumferential direction of the balancer 101 through the first catching protrusion 172 and the second catching protrusion 182 provided at the opposite ends thereof and the support ribs 128 provided at the balancer 101 and in the radial direction of the balancer 101 through the fastening hooks 192 provided at the inner circumference thereof. Consequently, the balancer guide 160 is stably coupled to the balancer 101 so that the balancer guide 160 is not separated from the balancer 101 during rotation of the drum 30.

Also, as shown in FIGS. 3, 4, and 9, the balancer guide 160 includes at least one fastening slot 169 disposed at a position corresponding to at least one fastening hole 129*a* in a state in which the balancer guide 160 is coupled to the balancer 101. The fastening slot 169 is formed in the shape of a long hole extending through a portion of the balancer guide 160 at which the fixed end 192*a* of the fastening hook 192 and the pressing rib 199 are formed so that the balancer 101 and the balancer guide 160 are easily fixed to the drum 30.

The fixing members 150 are coupled to the fastening holes 129*a* through though holes 37 formed at the cylinder part 31 of the drum 30 and the fastening slots 169 so that the balancer 101 and the balancer guides 160 are securely fixed to the drum 30.

Meanwhile, each balancer guide 160 may be formed of plastic, such as polypropylene (PP) or acrylonitrile butadiene styrene (ABS), by injection molding so that the balance guide 160 exhibits elasticity.

The balancer guide 160 is mounted to the recess 38 along with the balancer 101 in a state in which the balancer guide 160 is coupled to the balancer 101.

As shown in FIG. 9, the recess 38 includes a first support surface 38*a* to support the inner circumference of the balancer 101, which forms the inner diameter thereof, a second support surface 38*b* to support the outer circumference of the balancer guide 160, which forms the outer diameter thereof, and a third support surface 38*c* connected between the first support surface 38*a* and the second support surface 38*b* to support the balancer 101 and the balancer guide 160 in the axial direction of the drum 30.

Figure 11:
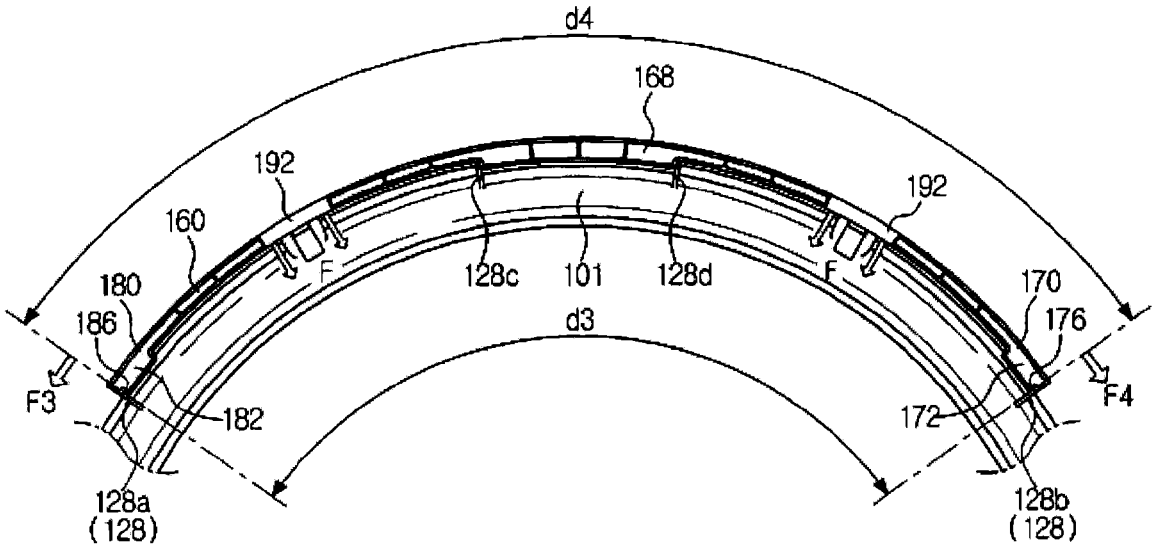
FIG. 11 is a view showing a modification of the balancer guide shown in FIG. 8.

FIG. 11 is a view showing a modification of the balancer guide shown in FIG. 8.

As shown in FIG. 11, in a state in which the balancer guide 160 is coupled to the balancer 101, the support ribs 128*a* and 128*b* are disposed outside a third contact surface 176 and a fourth contact surface 186 in contact with the third contact surface 176 and the fourth contact surface 186 to support the third contact surface 176 and the fourth contact surface 186 in different directions.

The inner distance d3 between the support ribs 128*a* and 128*b* in the circumferential direction of the balancer guide 160 may be less than the outer distance d4 between the first catching protrusion 172 and the second catching protrusion 182, i.e. the distance between the third contact surface 176 and the fourth contact surface 186. In a state in which the balancer guide 160 is coupled to the balancer 101, therefore, the third contact surface 176 and the fourth contact surface 186 press the support ribs 128*a* and 128*b* in different directions F3 and F4 using elastic restoring force generated by the decrease of the distance between the third contact surface 176 and the fourth contact surface 186 corresponding to the inner distance d3 between the support ribs 128*a* and 128*b* so that the balancer guide 160 is not separated from the balancer 101 but is securely fixed to the balancer 101. To prevent separation of the balancer guide 160, the outer distance d4 between the first catching protrusion 172 and the second catching protrusion 182 may be about 0.5 mm to 1.5 mm greater than the inner distance d3 between the support ribs 128*a* and 128*b*.

The balancer guide 160 with the above-stated construction is mounted to the balancer 101 as follows.

First, the balancer guide 160 is coupled to the outer circumference of the balancer 101. At this time, a position where the balancer guide 160 is disposed on the circumference of the balancer 101 is decided using the positioning protrusion 168 and the adjacent support ribs 128*c* and 128*d*. Also, the first catching protrusion 172 and the second catching protrusion 182 are coupled to the support ribs 128*a* and 128*b*, and the fastening hook 192 is coupled to the step protrusion 121. Subsequently, the balancer assembly 100, in which the balancer guide 160 is coupled to the balancer 101, is mounted to the recess 38 provided at the drum 30. At this time, the balancer assembly 100 may be mounted to the front or rear of the drum 30. Finally, the fixing members 150 are fastened to the fastening holes 129*a* through the through holes 37 formed at the cylinder part 31 of the drum 30 and the fastening slots 169 disposed at the positions corresponding to the through holes 37 in a state in which the balancer guide 160 is coupled to the balancer 101 so that the balancer assembly 100 is fixed to the drum 30.

Figure 12:
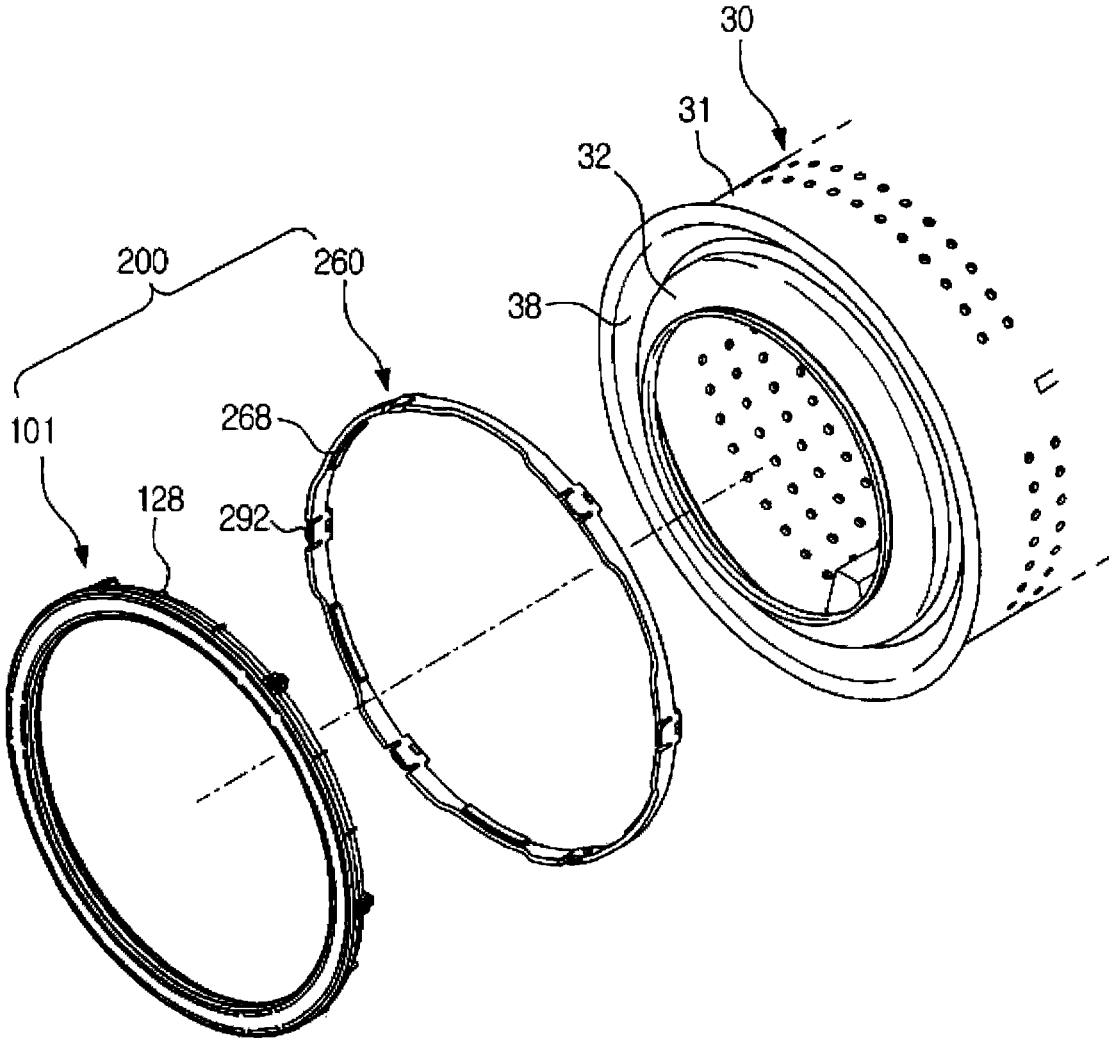
FIG. 12 is a perspective view showing a balancer guide according to another embodiment of the present disclosure.
Figure 13:
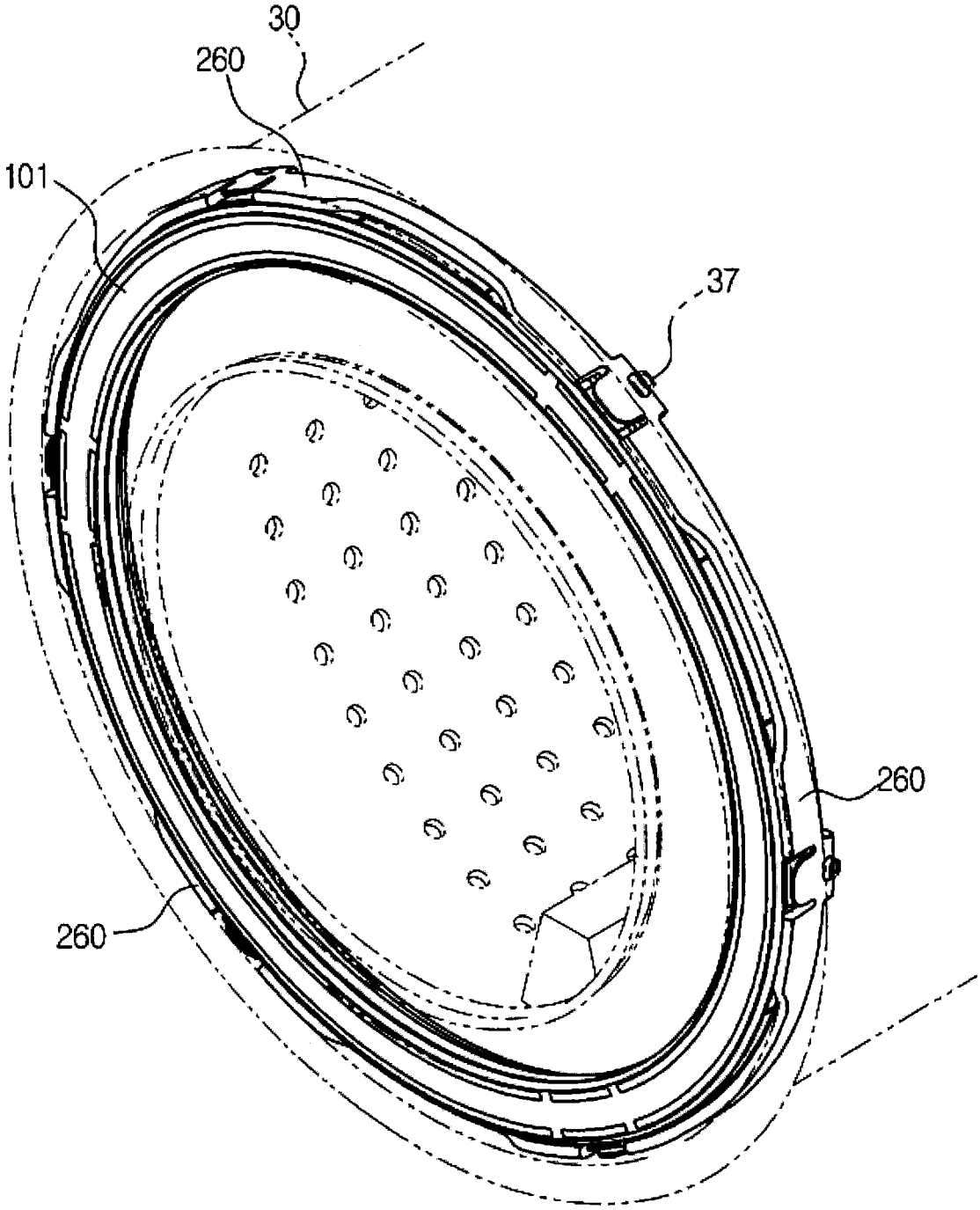
FIG. 13 is a view showing a state in which the balancer guide of FIG. 12 is coupled to the balancer.
Figure 14:
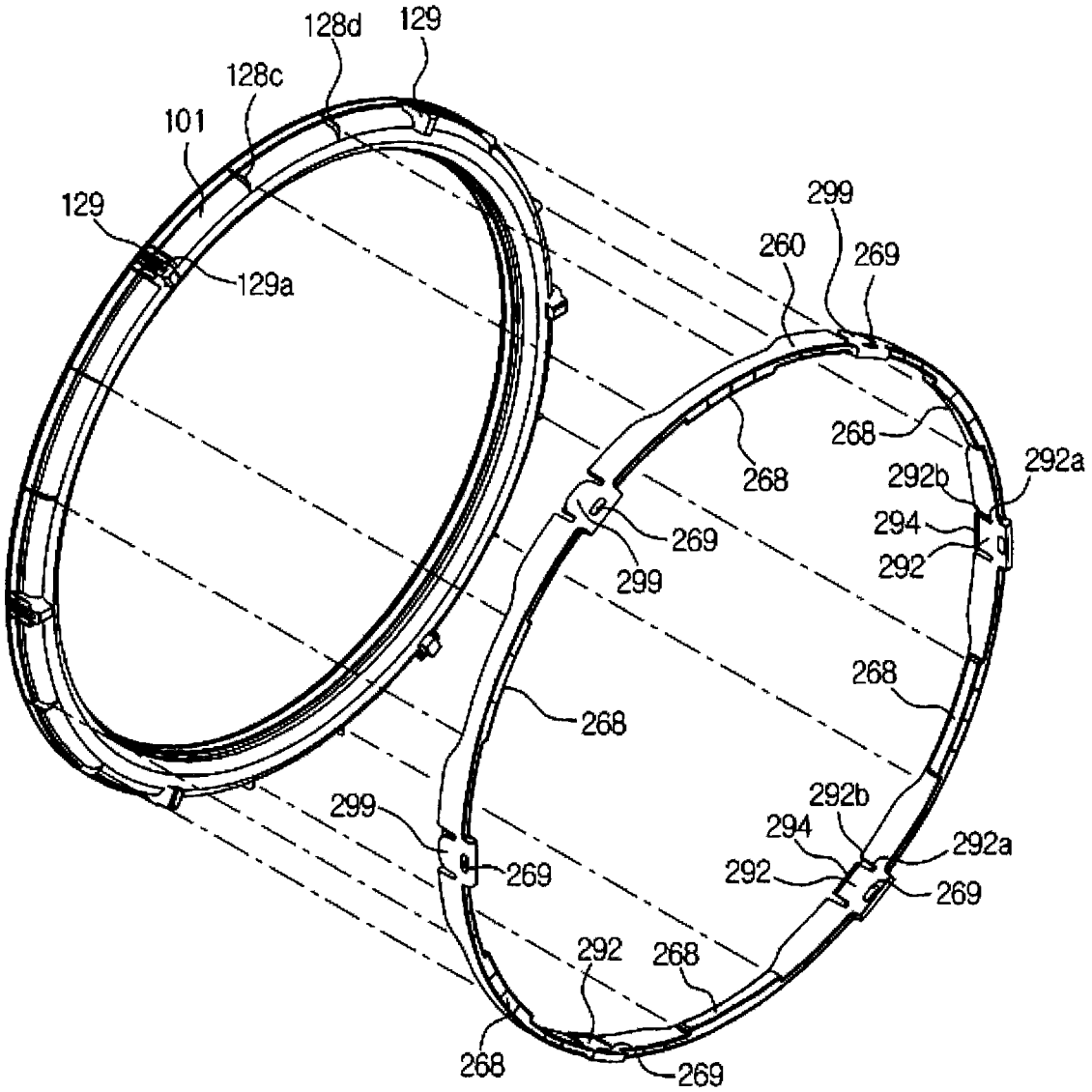
FIG. 14 is a view showing the balancer guide and balancer shown in FIG. 12 when viewed from the rear thereof.

FIG. 12 is a perspective view showing a balancer guide according to another embodiment of the present disclosure, FIG. 13 is a view showing a state in which the balancer guide of FIG. 12 is coupled to the balancer, and FIG. 14 is a view showing the balancer guide and balancer shown in FIG. 12 when viewed from the rear thereof.

As shown in FIGS. 12 to 14, a balancer guide 260, constituting a balancer assembly 200 together with the balancer 101, may be formed in the shape of a ring having a diameter corresponding to the outer circumference of the balancer 101, which forms the outer diameter thereof.

The balancer guide 260 includes a positioning protrusion 268 protruding from the inner circumference of the balancer guide 260, which forms the inner diameter thereof, in the center direction of the balancer guide 260 and at least one fastening hook 292 formed by cutting a portion of the inner circumference of the balancer 260, which forms the inner diameter thereof.

The positioning protrusion 268 is inserted between two adjacent support ribs 128*c* and 128*d* during the coupling of the balancer guide 260 to the balancer 101. A worker may reliably decide a coupling position between the balancer 101 and the balancer guide 260 using the positioning protrusion 268. The support ribs 128*c* and 128*d* support opposite ends of the positioning protrusion 268 disposed therebetween to prevent the balancer guide 260 from moving in the circumferential direction of the balancer 101.

The fastening hook 292 includes a fixed end 292*a* and a free end 292*b*. The free end 292*b* is formed by cutting a portion of the inner circumference of the balancer guide 260, which forms the inner diameter thereof, so that the free end 292*b* is easily elastically deformed approximately in the center direction or radial direction of the balancer guide 260.

The free end 292*b* is provided with a hook protrusion 294 protruding from the inner circumference of the balancer guide 260 to the radial-directional inside of the balancer guide 260. The hook protrusion 294 is caught by the step protrusion 121 formed by the first housing 120 and the second housing 130 so that the balancer guide 260 is not separated from the balancer 101 but is securely fixed to the balancer 101.

The hook protrusion 294 presses the outer circumference of the balancer 101 in the center direction F of the balancer guide 260 by elastic restoring force generated as the hook protrusion 294 is deformed in the radial direction of the balancer guide 260 when the hook protrusion 294 is fastened to the step protrusion 121 so that the balancer guide 260 is not separated from the balancer 101 but is securely fixed to the balancer 101. To prevent separation of the balancer guide 260, the length of the hook protrusion 294 protruding toward the radial-directional inside of the balancer guide 260 may be about 0.5 mm to 1.5 mm.

The balancer guide 260 includes a pressing rib 299 provided at the outside of the fastening hook 292 in the radial direction of the balancer guide 260 so that the fastening hook 292 presses the outer circumference of the balancer 101 as described above.

The pressing rib 299 supports the hook protrusion 294 in the center direction F of the balancer guide 260 in a state in which the hook protrusion 294 is fastened to the step protrusion 121 so that the hook protrusion 294 stably presses the outer circumference of the balancer 101 in the center direction F of the balancer guide 260.

As described above, the balancer guide 260 is fastened and supported in the circumferential direction of the balancer 101 through the positioning protrusion 268 protruding from the inner circumference of the balancer guide 260 in the center direction of the balancer guide 260 and the support ribs 128*c* and 128*d* provided at the balancer 101 and in the radial direction of the balancer 101 through the fastening hooks 292 provided at the inner circumference thereof. Consequently, the balancer guide 260 is stably coupled to the balancer 101 so that the balancer guide 260 is not separated from the balancer 101 during rotation of the drum 30.

Also, as shown in FIG. 14, the balancer guide 260 includes at least one fastening slot 269 disposed at a position corresponding to at least one fastening hole 129*a* in a state in which the balancer guide 260 is coupled to the balancer 101. The fastening slot 269 is formed in the shape of a long hole extending through a portion of the balancer guide 260 at which the fixed end 292*a* of the fastening hook 292 and the pressing rib 299 are formed so that the balancer 101 and the balancer guide 260 are easily fixed to the drum 30.

The fixing members 150 are coupled to the fastening holes 129*a* through the though holes 37 formed at the cylinder part 31 of the drum 30 and the fastening slots 269 so that the balancer 101 and the balancer guides 260 are securely fixed to the drum 30.

The balancer guide 260 with the above-stated construction is mounted to the balancer 101 as follows.

First, the balancer guide 260 is coupled to the outer circumference of the balancer 101. At this time, a position where the balancer guide 260 is disposed on the circumference of the balancer 101 is decided using the positioning protrusion 268 and the adjacent support ribs 128*c* and 128*d*. Also, the fastening hook 192 is coupled to the step protrusion 121. Subsequently, the balancer assembly 200, in which the balancer guide 260 is coupled to the balancer 101, is mounted to the recess 38 provided at the drum 30. At this time, the balancer assembly 200 may be mounted to the front or rear of the drum 30. Finally, the fixing members 150 are fastened to the fastening holes 129*a* through the through holes 37 formed at the cylinder part 31 of the drum 30 and the fastening slots 269 disposed at the positions corresponding to the through holes 37 in a state in which the balancer guide 260 is coupled to the balancer 101 so that the balancer assembly 200 is fixed to the drum 30.

Figure 15:
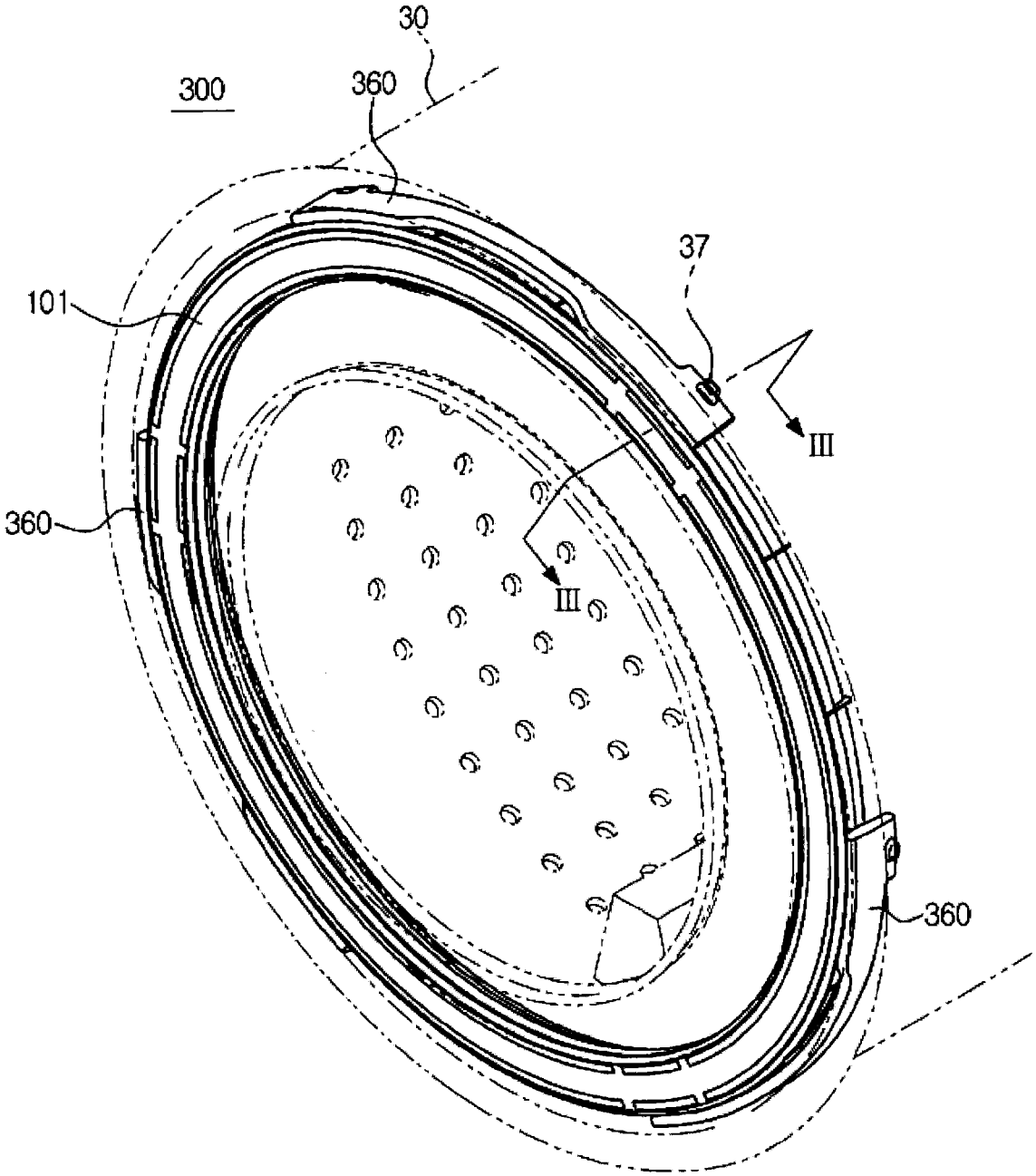
FIG. 15 is a perspective view showing a balancer guide according to another embodiment of the present disclosure.
Figure 16:
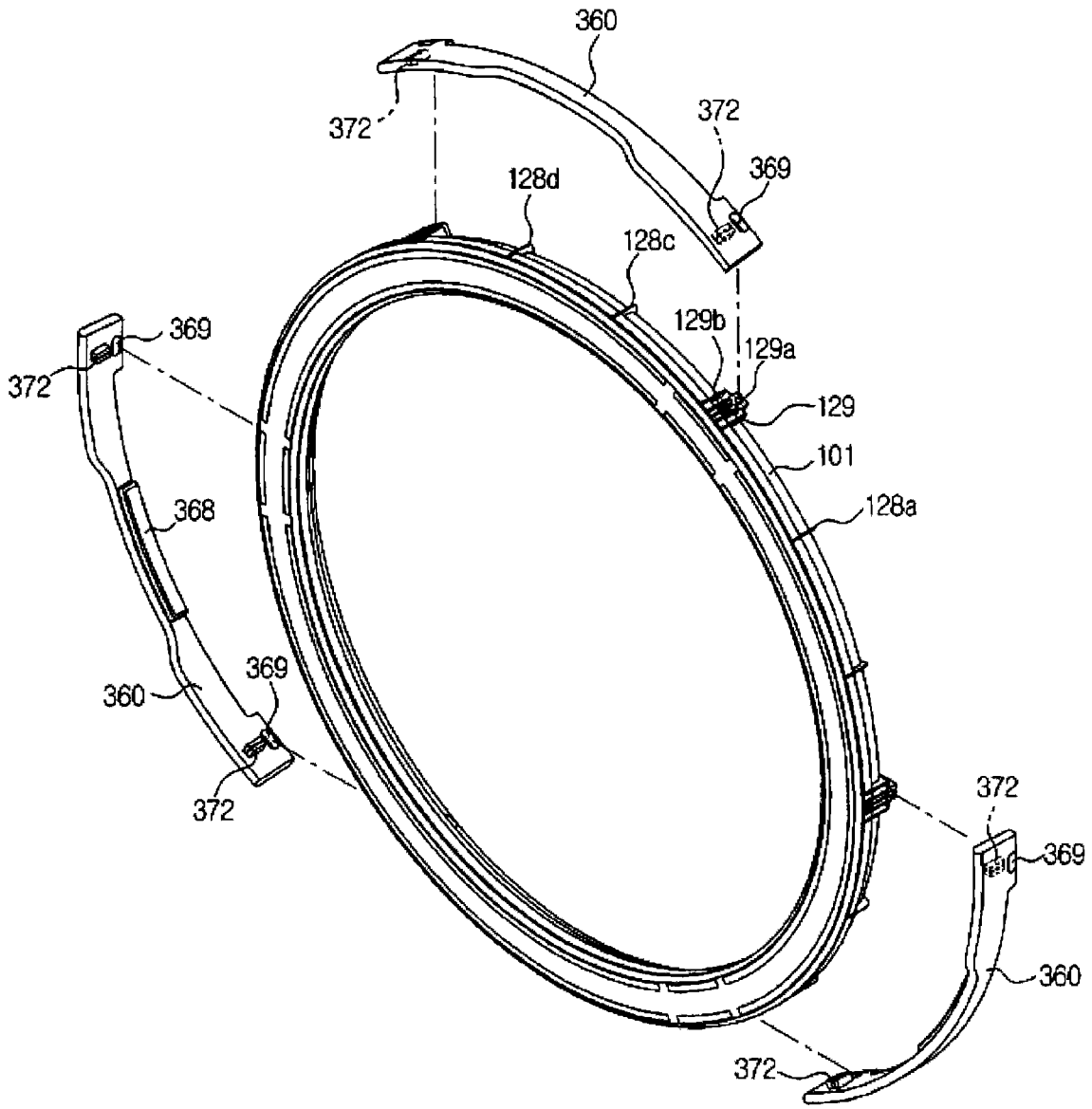
FIG. 16 is an exploded perspective view showing the balancer and the balancer guide according to the embodiment of the present disclosure.
Figure 17:
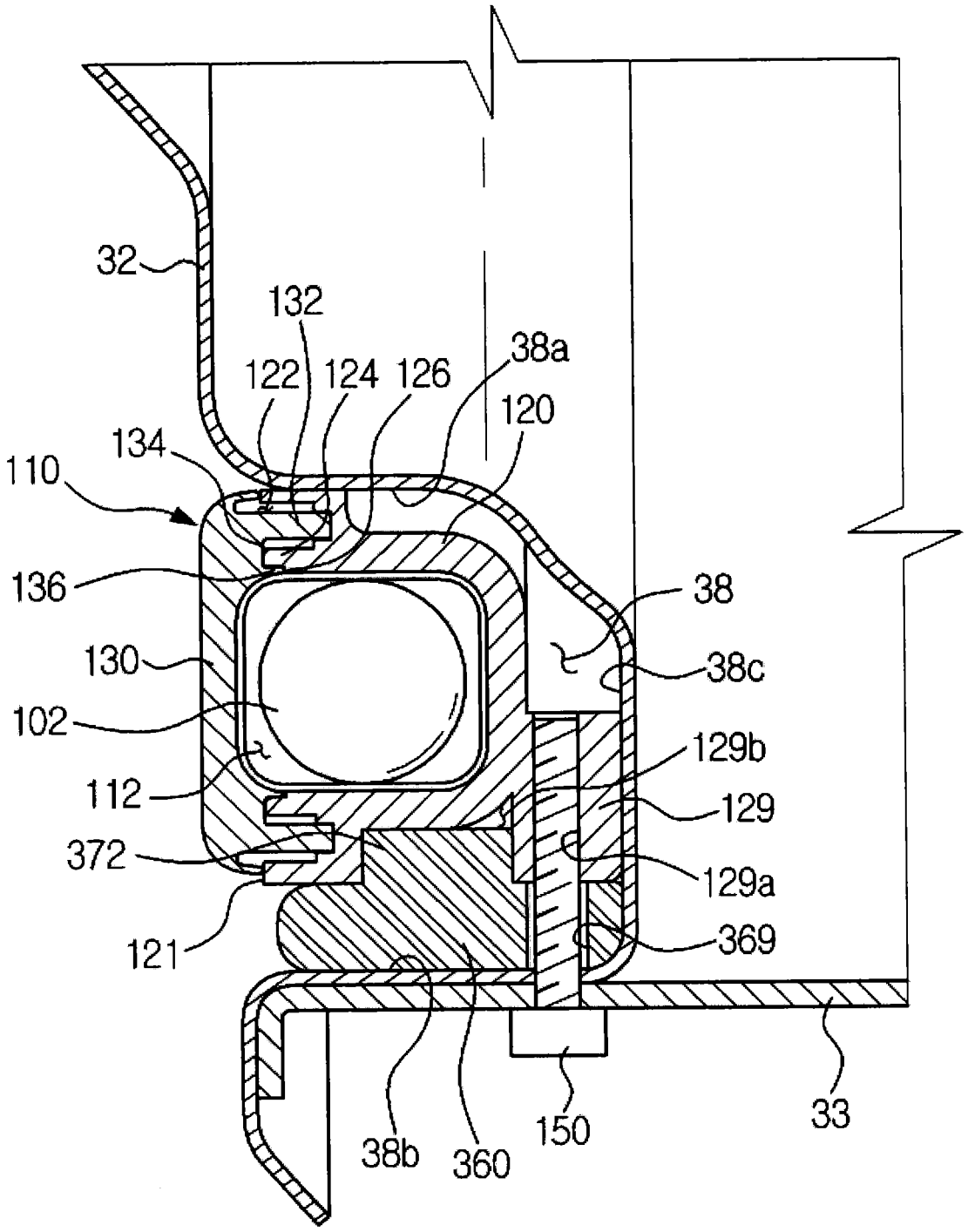
FIG. 17 is a sectional view taken along line III-III of FIG. 15.

FIG. 15 is a perspective view showing a balancer guide according to another embodiment of the present disclosure, FIG. 16 is an exploded perspective view showing the balancer and the balancer guide according to the embodiment of the present disclosure, and FIG. 17 is a sectional view taken along line III-III of FIG. 15.

As shown in FIGS. 15 to 17, a plurality of balancer guides 360, constituting a balancer assembly 300 together with the balancer 101, may be disposed in the circumferential direction of the balancer 101 so that the balancer guides 360 are coupled to the balancer 101. Each balancer guide 360 includes a positioning protrusion 368 protruding from the inner circumference of the balancer guide 360, which forms the inner diameter thereof, in the center direction of the balancer guide 360 and at least one fastening protrusion 372 protruding from the inner circumference of the balancer guides 360 outside the positioning protrusion 368.

The positioning protrusion 368 is inserted between two adjacent support ribs 128*c* and 128*d* during the coupling of the balancer guide 360 to the balancer 101. A worker may reliably decide a coupling position between the balancer 101 and the balancer guide 360 using the positioning protrusion 368. The support ribs 128*c* and 128*d* support opposite ends of the positioning protrusion 368 disposed therebetween to prevent the balancer guide 360 from moving in the circumferential direction of the balancer 101.

The fastening protrusion 372 is provided at each end of the balancer guide 360. During the coupling of the balancer guide 360 to the balancer 101, the fastening protrusion 372 is inserted into at least one receiving groove 129*b* formed at each fastening rib 129. As the fastening protrusion 372 is inserted and supported in the receiving groove 129*b*, the movement of the balancer 101 in the circumferential direction and in the axial direction is prevented in a state in which the balancer guide 360 is coupled to the balancer 101.

The number of the receiving grooves 129*b* and the fastening protrusions 372 inserted into the receiving grooves 129*b* is not limited to two as shown in FIG. 16. At least one receiving groove 129*b* and at least one fastening protrusion 372 may be provided depending upon required coupling strength. Also, the number of the receiving grooves 129*b* may not coincide with that of the fastening protrusions 372. For example, the number of the receiving grooves 129*b* may be equal to or greater than that of the fastening protrusions 372 so that all of the fastening protrusions 372 are received in the receiving grooves 129*b*.

Also, as shown in FIG. 16, the balancer guide 360 includes at least one fastening slot 369 disposed at a position corresponding to at least one fastening hole 129*a* in a state in which the balancer guide 360 is coupled to the balancer 101. The fastening slot 369 is formed in the shape of a long hole extending through a portion of the balancer guide 360 at which the fastening protrusion 372 is formed so that the balancer 101 and the balancer guide 360 are easily fixed to the drum 30.

The fixing members 150 shown in FIG. 17 are coupled to the fastening holes 129*a* through the though holes 37 formed at the cylinder part 31 of the drum 30 and the fastening slots 369 formed at the balancer guide 360 so that the balancer 101 and the balancer guides 360 are securely fixed to the drum 30.

Figure 18:
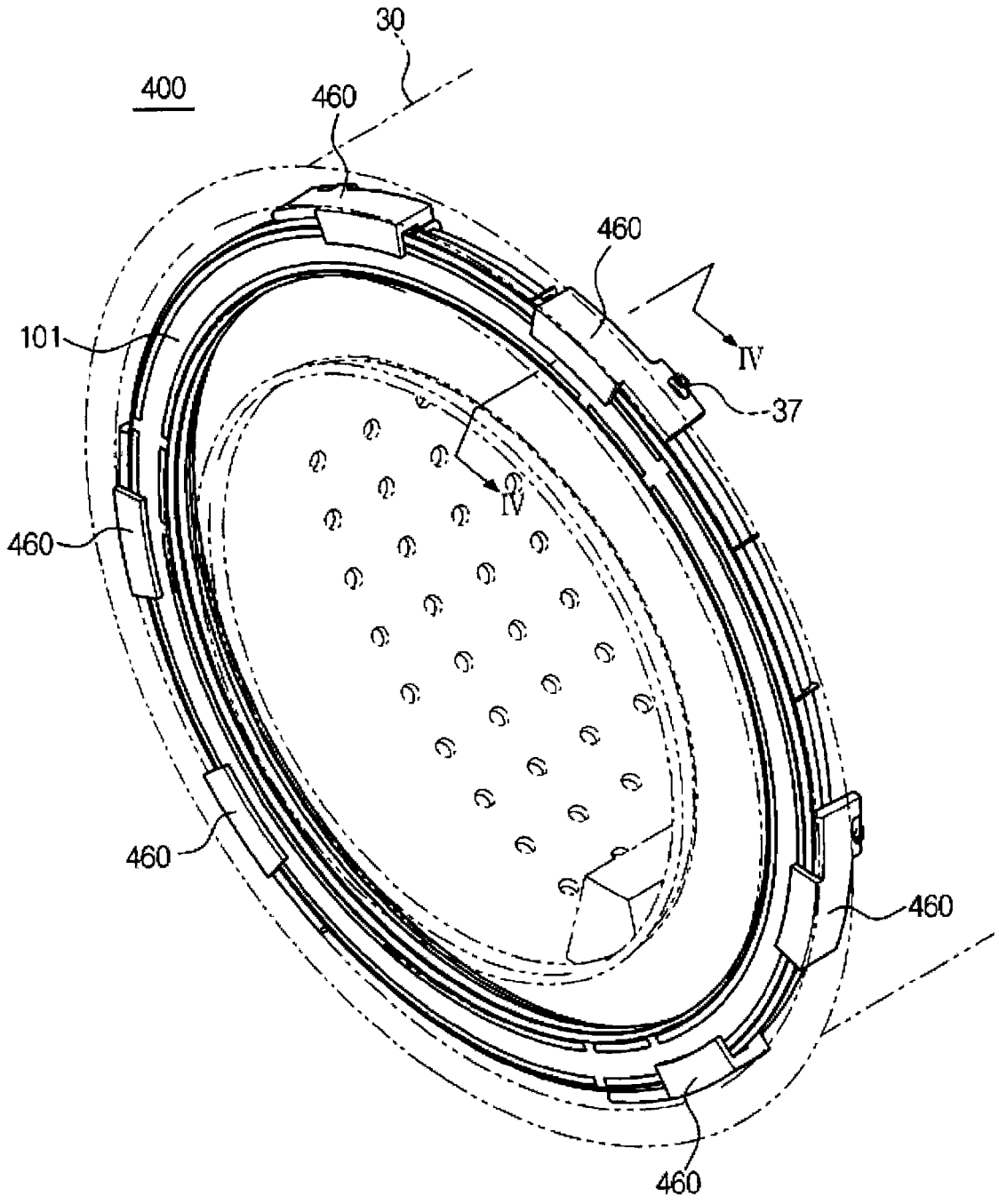
FIG. 18 is a perspective view showing a balancer guide according to a further embodiment of the present disclosure.
Figure 19:
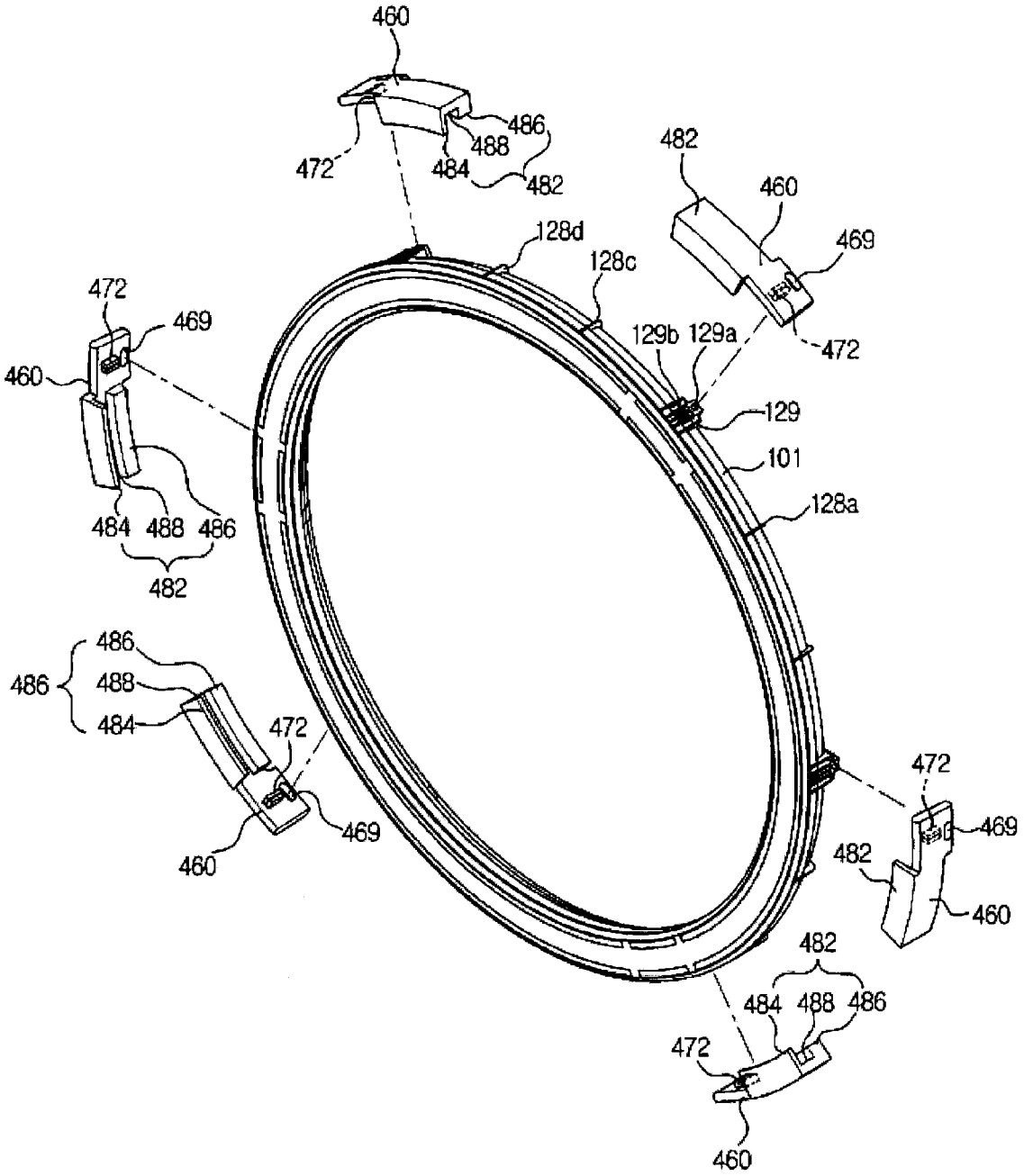
FIG. 19 is an exploded perspective view showing the balancer and the balancer guide according to the embodiment of the present disclosure.
Figure 20:
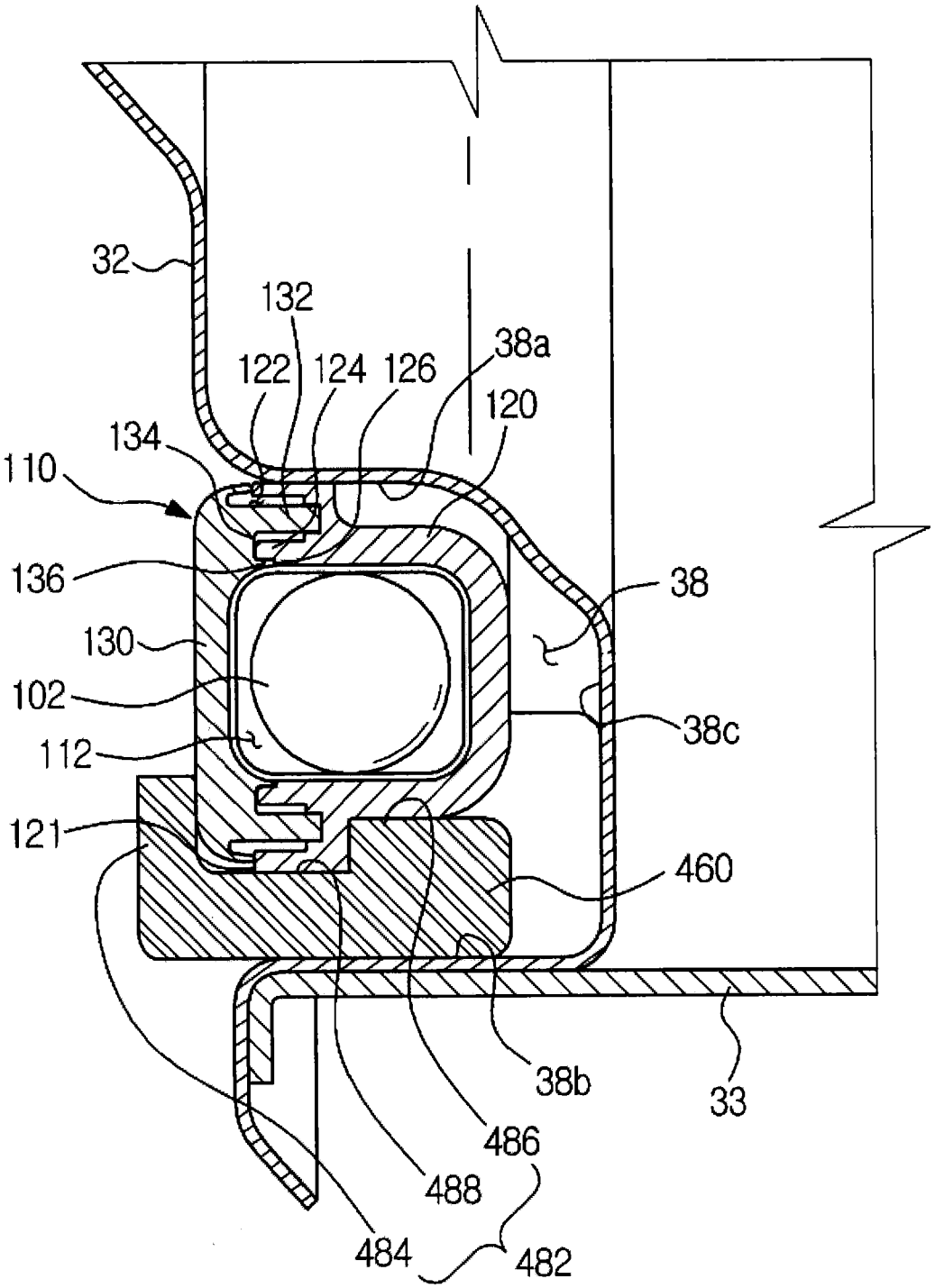
FIG. 20 is a sectional view taken along line IV-IV of FIG. 18.

FIG. 18 is a perspective view showing a balancer guide according to a further embodiment of the present disclosure, FIG. 19 is an exploded perspective view showing the balancer and the balancer guide according to the embodiment of the present disclosure, and FIG. 20 is a sectional view taken along line IV-IV of FIG. 18.

As shown in FIGS. 18 to 20, a plurality of balancer guides 460, constituting a balancer assembly 400 together with the balancer 101, may be disposed in the circumferential direction of the balancer 101 so that the balancer guides 460 are coupled to the balancer 101. Each balancer guide 460 includes at least one fastening protrusion 472 protruding from the inner circumference of the balancer guide 460, which forms the inner diameter thereof, in the center direction of the balancer guide 460 and a catching part 482 surrounding a portion of the outside of the balancer housing.

The fastening protrusion 472 is provided at each end of the balancer guide 460. During the coupling of the balancer guide 460 to the balancer 101, the fastening protrusion 472 is inserted into at least one receiving groove 129*b* formed at each fastening rib 129. As the fastening protrusion 472 is inserted and supported in the receiving groove 129*b*, the movement of the balancer 101 in the circumferential direction and in the axial direction is prevented in a state in which the balancer guide 460 is coupled to the balancer 101.

The number of the receiving grooves 129*b* and the fastening protrusions 472 inserted into the receiving grooves 129*b* is not limited to two as shown in FIG. 19. At least one receiving groove 129*b* and at least one fastening protrusion 472 may be provided depending upon required coupling strength. Also, the number of the receiving grooves 129*b* may not coincide with that of the fastening protrusions 472. For example, the number of the receiving grooves 129*b* may be equal to or greater than that of the fastening protrusions 472 so that all of the fastening protrusions 472 are received in the receiving grooves 129*b*.

The catching part 482 includes a first support protrusion 484 to support the front of the balancer housing 110, a second support protrusion 486 to support the rear of the balancer housing 110, and a support surface 488 provided between the first support protrusion 484 and the second support protrusion 486 to support the outer circumference of the balancer housing 110.

The first support protrusion 484 and the second support protrusion 486 prevent the balancer 101 from moving in the axial direction in a state in which the balancer guide 460 is coupled to the balancer 101, and the support surface 488 prevents the balancer 101 from moving in the radial direction in a state in which the balancer guide 460 is coupled to the balancer 101.

Also, as shown in FIG. 19, the balancer guide 460 includes at least one fastening slot 469 disposed at a position corresponding to at least one fastening hole 129*a* in a state in which the balancer guide 460 is coupled to the balancer 101. The fastening slot 469 is formed in the shape of a long hole extending through a portion of the balancer guide 460 at which the fastening protrusion 472 is formed so that the balancer 101 and the balancer guide 460 are easily fixed to the drum 30.

The fixing members 150 are coupled to the fastening holes 129*a* through the though holes 37 formed at the cylinder part 31 of the drum 30 and the fastening slots 469 formed at the balancer guide 460 so that the balancer 101 and the balancer guides 460 are securely fixed to the drum 30.

The balancer guide 360 or 460 with the above-stated construction is mounted to the balancer 101 as follows.

First, the balancer guide 360 or 460 is coupled to the outer circumference of the balancer 101. At this time, the fastening protrusions 372 or 472 provided at the balancer guide 360 or 460 are inserted into the receiving grooves 129*b* provided at the fastening ribs 129 of the balancer 101. Subsequently, the balancer assembly 300 or 400, in which the balancer guide 360 or 460 is coupled to the balancer 101, is mounted to the recess 38 provided at the drum 30. At this time, the balancer assembly 300 or 400 may be mounted to the front or rear of the drum 30. Finally, the fixing members 150 are fastened to the fastening holes 129*a* through the through holes 37 formed at the cylinder part 31 of the drum 30 and the fastening slots 369 or 469 disposed at the positions corresponding to the through holes 37 in a state in which the balancer guide 360 or 460 is coupled to the balancer 101 so that the balancer assembly 300 or 400 is fixed to the drum 30.

The shape of the balancer 101 may be compensated by mounting the balancer guide 160, 260, 360, or 460 to the outer circumference of the balancer 101. The balancer housing 110 constituting the balancer 101 may be formed of plastic, such as polypropylene (PP) or acrylonitrile butadiene styrene (ABS), by injection molding. If the material is deformed during injection molding due to properties of the material, however, the balancer housing 110 may be distorted. As a result, concentricity and circularity of the balancer housing 110 may be low. The balancer guide 160, 260, 360, or 460 is coupled to the outer circumference of the balancer 101 and is fixed to the recess 38 formed at the drum 30, which is made of a metal or other suitably rigid material, along with the balancer 101 by the fixing members 150 to compensate the concentricity and circularity of the balancer 101.

Also, the balancer guide 160, 260, 360, or 460 restrains deformation of the balancer 101, which exhibits lower rigidity than the drum 30, when the balancer 101 is fixed to the recess 38 by the fixing members 150. Furthermore, the balancer guide 160, 260, 360, or 460 is disposed between the recess 38 and the balancer 101 to absorb vibration and noise generated during rotation of the drum 30.

Hereinafter, a principle of commonly using the balancer 101 using the balancer guide 160, 260, 360, or 460 irrespective of the size, i.e. the diameter, of the drum 30 will be described.

Figure 21:
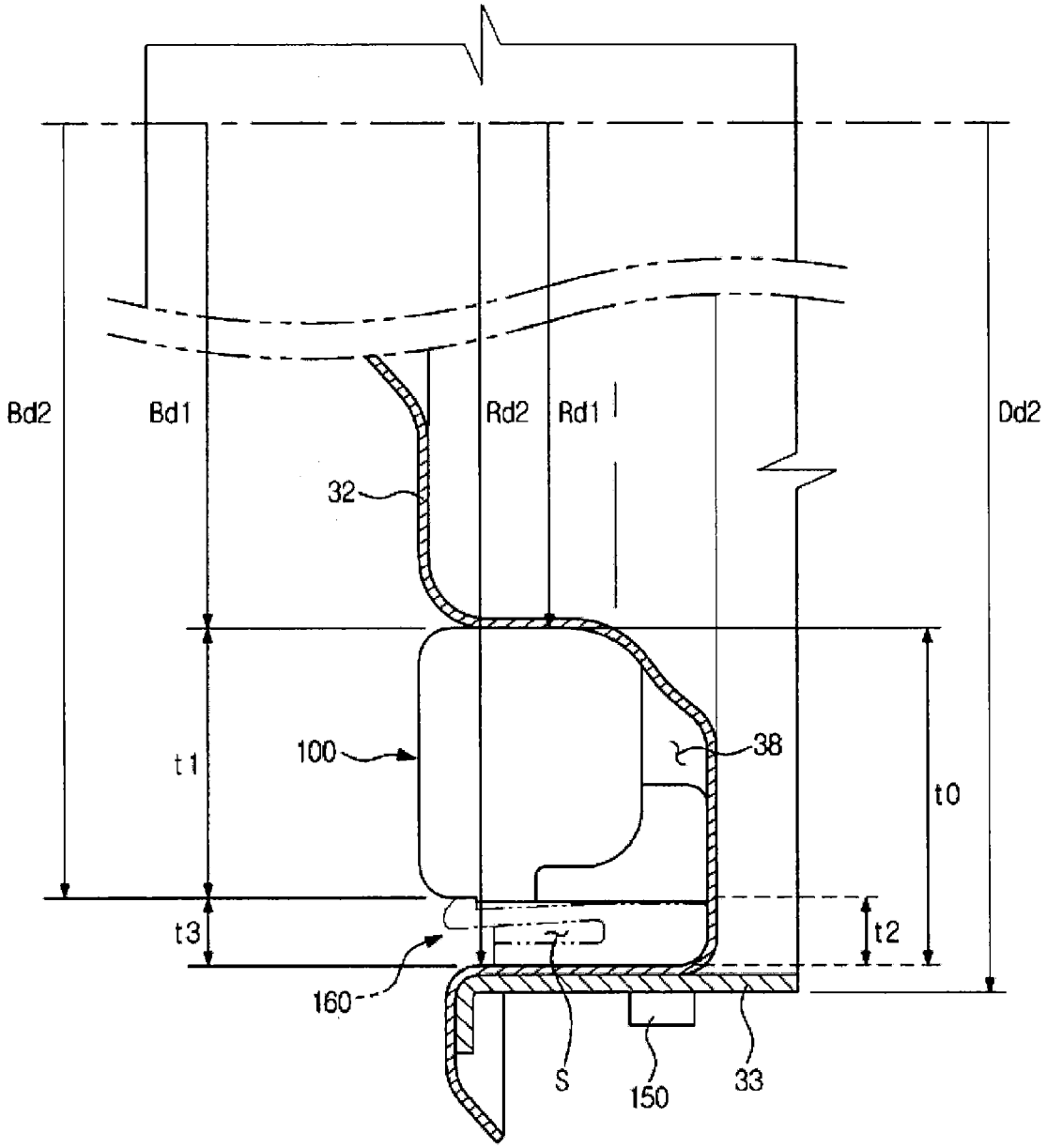
FIG. 21 is a view showing a principle of commonly using a balancer using a balancer guide.

FIG. 21 is a view showing a principle of commonly using the balancer using the balancer guide.

The inner diameter Bd1 and the outer diameter Bd2 of the balancer 101 are fixed. The inner diameter Rd1 of the recess 38 formed by the first support surface 38*a* supporting the inner diameter Bd1 of the balancer 101 is fixed irrespective of the outer diameter Dd2 of the drum 30, and the outer diameter Rd2 of the recess 38 formed by the second support surface 38*b* is increased in proportion to the outer diameter Dd2 of the drum 30.

When the outer diameter Dd2 of the drum 30 is increased, the outer diameter Rd2 of the recess 38 is also increased, which means that the radial-directional distance t0 between the first support surface 38*a* and the second support surface 38*b* constituting the recess 38 is increased. As previously described, the inner diameter Bd1 and the outer diameter Bd2 of the balancer 101 are fixed, and therefore, the distance t1 between the inner diameter Bd1 and the outer diameter Bd2 of the balancer 101 is also fixed. When the outer diameter Dd2 of the drum 30 is increased, and the balancer 101 is mounted to the recess 38 of the drum 30, a space S corresponding to an increased portion t2 of the radial-directional distance t0 between the first support surface 38*a* and the second support surface 38*b* is formed between the outer diameter Bd2 of the balancer 101 and the second support surface 38*b*. In the space S is positioned the balancer guide 160, 260, 360, or 460 having a thickness t3 corresponding to the increased portion t2 of the radial-directional distance between the first support surface 38*a* and the second support surface 38*b*.

That is, as the outer diameter Dd2 of the drum 30 is increased, the radial-directional distance t0 between the first support surface 38*a* and the second support surface 38*b* is increased, and the balancer guide 160, 260, 360, or 460 is manufactured to have a thickness t3 corresponding to the increased portion t2 of the radial-directional distance t0 between the first support surface 38*a* and the second support surface 38*b*. Consequently, the balancer 101 may be commonly used irrespective of the size of the drum 30.

As is apparent from the above description, the balancer is mounted to the drum in a state in which an additional member is coupled to the outer circumference of the balancer in the direction to increase the radius of the balancer, and therefore, the balancer may be commonly used irrespective of the size of the drum.

Also, since the balancer is commonly used irrespective of the size of the drum, cost and time to develop various balancers corresponding to different diameters of the drum are reduced, thereby improving productivity.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a drum rotatably disposed in the cabinet;

an annular recess provided at the drum; and a balancer assembly mounted to the recess, wherein the balancer assembly comprises a balancer to offset unbalanced load generated in the drum during rotation of the drum; and at least one balancer guide coupled to an outer circumference of the balancer to constitute the balancer assembly, the balancer guide being mounted in the recess and supporting the balancer so that an outer diameter of the balancer assembly corresponds to the recess, wherein the balancer comprises a plurality of support ribs provided at the outer circumference of the balancer so as to be disposed in a circumferential direction of the balancer, and the support ribs comprise a first support rib to support a first end of the balancer guide in a circumferential direction of the balancer guide in a state in which the balancer guide is coupled to the balancer, and a second support rib spaced apart from the first support rib to support a second end of the balancer guide in a direction opposite to the first end.

2. The washing machine according to claim 1, wherein the balancer further comprises a plurality of fastening ribs disposed in a circumferential direction thereof, and at least one of the plurality of support ribs disposed between the fastening ribs.

3. The washing machine according to claim 1, wherein the balancer further comprises a plurality of fastening ribs disposed in a circumferential direction thereof, and the balancer guide contacts at least one of the fastening ribs.

4. The washing machine according to claim 1, wherein the balancer further comprises a plurality of fastening ribs disposed in a circumferential direction thereof, and at least one of the plurality of support ribs is disposed between the fastening ribs, and the balancer guide contacts at least one of the fastening ribs.

5. The washing machine according to claim 1, wherein the first end and the second end comprise a first catching protrusion and a second catching protrusion stepped from an inner circumference of the balancer guide and supported by one surface of the first support rib and one surface of the second support rib.

6. The washing machine according to claim 5, wherein the first support rib and the second support rib are disposed between the first catching protrusion and the second catching protrusion.

7. The washing machine according to claim 6, wherein an inner distance between the first catching protrusion and the second catching protrusion in the circumferential direction of the balancer is less than an outer distance between the first support rib and the second support rib.

8. The washing machine according to claim 5, wherein the first support rib and the second support rib are disposed outside the first catching protrusion and the second catching protrusion, respectively.

9. The washing machine according to claim 6, wherein an outer distance between the first catching protrusion and the second catching protrusion in the circumferential direction of the balancer is greater than an inner distance between the first support rib and the second support rib.

10. The washing machine according to claim 1, wherein the balancer guide comprises a positioning protrusion provided between the first end and the second end, protruding from an inner circumference of the balancer guide to a radial-directional inside of the balancer guide, and inserted between adjacent support ribs.

11. The washing machine according to claim 1, wherein the balancer guide comprises at least one fastening hook fastened to the outer circumference of the balancer to press the outer circumference of the balancer in a center direction of the balancer.

12. The washing machine according to claim 11, wherein the fastening hook is formed at an inner circumference of the balancer guide, and one end of the fastening hook fastened to the outer circumference of the balancer protrudes more in the center direction of the balancer than the inner circumference of the balancer guide.

13. The washing machine according to claim 1, wherein the balancer comprises a ball balancer comprising an annular housing and a plurality of balls movably disposed in the housing.

14. The washing machine according to claim 1, wherein the at least one balancer guide comprises a plurality of balancer guides disposed in a circumferential direction of the balancer.

15. The washing machine according to claim 1, wherein the recess comprises:

a first support surface to support an inner circumference of the balancer;

a second support surface to support an outer circumference of the balancer guide; and a third support surface connected between the first support surface and the second support surface to support the balancer and the balancer guide in an axial direction of the drum.

16. The washing machine according to claim 1, wherein the balancer comprises a plurality of fastening ribs provided at the outer circumference of the balancer so as to be disposed in a circumferential direction of the balancer.

17. The washing machine according to claim 16, wherein each of the fastening ribs comprises at least one receiving groove, and the balancer guide comprises at least one fastening protrusion protruding from an inner circumference thereof so as to be received and coupled in the receiving groove.

18. The washing machine according to claim 16, wherein the balancer comprises an annular balancer housing forming an external appearance thereof, and the balancer guide comprises a catching part surrounding a portion of an outside of the balancer housing to prevent the balancer guide from moving in a center direction and in an axial direction in a state in which the balancer guide is coupled to the balancer.

19. The washing machine according to claim 18, wherein the catching part comprises a first support protrusion to support a front of the balancer housing and a second support protrusion to support a rear of the balancer housing so that the balancer guide is prevented from moving in the axial direction.

20. The washing machine according to claim 19, wherein the catching part comprises a support surface provided between the first support protrusion and the second support protrusion to support an outer circumference of the balancer housing.

21. The washing machine according to claim 1, further comprising at least one fastening member, wherein the balancer guide is fastened to an outer circumference of the balancer by the at least one fastening member, the at least fastening member extending through the balancer guide and into the balancer to concurrently secure the balancer.

22. A washing machine comprising:

a drum comprising a cylinder part, a front plate disposed at a front of the cylinder part, and a rear plate disposed at a rear of the cylinder part;

an annular recess provided at the front plate and/or the rear plate;

a balancer mounted to the annular recess to offset unbalanced load generated in the drum during rotation of the drum; and a balancer guide disposed in a space defined by an outer circumference of the balancer and the recess, the balancer guide being configured to support the balancer, wherein the balancer comprises a plurality of support ribs provided at the outer circumference of the balancer so as to be disposed in a circumferential direction of the balancer, and the balancer guide is provided at opposite ends thereof with a first catching protrusion and a second catching protrusion formed at a radial-directional inside of the balancer guide so as to be stepped from an inner circumference of the balancer guide, the first catching protrusion and the second catching protrusion contacting corresponding surfaces of two different ones of the support ribs.

23. The washing machine according to claim 22, wherein the recess comprises:

a first support surface to support an inner circumference of the balancer; and a second support surface provided at an outward radial-directional position so as to be spaced apart from the first support surface, and the balancer guide is disposed between the outer circumference of the balancer and the second support surface.

24. The washing machine according to claim 23, wherein the recess comprises a third support surface connected between the first support surface and the second support surface to support the balancer and the balancer guide in an axial direction of the drum.

25. The washing machine according to claim 23, wherein the balancer guide comprises at least two balancer guides disposed between the outer circumference of the balancer and the second support surface in a circumferential direction of the balancer.

26. The washing machine according to claim 22, wherein the first catching protrusion presses one of the two different support ribs in the circumferential direction of the balancer, and the second catching protrusion presses the other support rib in a direction opposite to the circumferential direction.

27. The washing machine according to claim 26, wherein the balancer guide comprises a positioning protrusion provided between the first catching protrusion and the second catching protrusion, protruding from the inner circumference of the balancer guide to the radial-directional inside of the balancer guide, and inserted between adjacent support ribs.

28. The washing machine according to claim 22, wherein the balancer guide comprises at least one fastening hook protruding from an inner circumference of the balancer guide to a radial-directional inside of the balancer guide, and the fastening hook is fastened to the outer circumference of the balancer to press the outer circumference of the balancer in a center direction of the balancer.

29. The washing machine according to claim 22, further comprising at least one fastening member, wherein the balancer guide is fastened to an outer circumference of the balancer by the at least one fastening member, the at least fastening member extending through the balancer guide and into the balancer to concurrently secure the balancer.

* * * * *